US010503110B2

(12) United States Patent
Kimura

(10) Patent No.: US 10,503,110 B2
(45) Date of Patent: Dec. 10, 2019

(54) IMAGE FORMING APPARATUS, DEVELOPING DEVICE, AND IMAGE FORMING UNIT

(71) Applicant: Hideki Kimura, Kanagawa (JP)

(72) Inventor: Hideki Kimura, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/273,212

(22) Filed: Feb. 12, 2019

(65) Prior Publication Data

US 2019/0258199 A1 Aug. 22, 2019

(30) Foreign Application Priority Data

Feb. 21, 2018 (JP) ..... 2018-028766

(51) Int. Cl.

| | |
|---|---|
| ***G03G 15/06*** | (2006.01) |
| ***G03G 15/00*** | (2006.01) |
| ***G03G 15/08*** | (2006.01) |

(52) U.S. Cl.

CPC ..... *G03G 15/5058* (2013.01); *G03G 15/0855* (2013.01); *G03G 15/0865* (2013.01); *G03G 15/0889* (2013.01); *G03G 15/0891* (2013.01)

(58) Field of Classification Search

CPC ..... G03G 15/5058; G03G 15/0855; G03G 15/0865; G03G 15/0889; G03G 15/0891

See application file for complete search history.

(56) References Cited

U.S. PATENT DOCUMENTS

| | | | | |
|---|---|---|---|---|
| 5,300,987 | A | 4/1994 | Aoyama et al. | |
| 2002/0003967 | A1 | 1/2002 | Okada | |
| 2007/0212086 | A1* | 9/2007 | Yagawara | G03G 15/0131 399/49 |

(Continued)

FOREIGN PATENT DOCUMENTS

| | | |
|---|---|---|
| JP | 2002-023471 | 1/2002 |
| JP | 2006-091629 | 4/2006 |

(Continued)

OTHER PUBLICATIONS

European Office Action Issued in European Patent Application No. 19156564.7 dated Jul. 16, 2019 (8 pages).

*Primary Examiner* — Hoang X Ngo
(74) *Attorney, Agent, or Firm* — Oblon, McClelland, Maier & Neustadt, L.L.P.

(57) ABSTRACT

An image forming apparatus includes a latent image bearer configured to bear a latent image and a developing device configured to develop the latent image on the latent image bearer with developer. The developing device includes a plurality of developer bearers configured to bear the developer. The image forming apparatus further includes a rotation position detector configured to detect a rotation position of at least one of the plurality of developer bearers, a common power source configured to apply a developing bias to each of the plurality of developer bearers, and circuitry configured to cause the common power source to periodically vary the developing bias. The circuitry is configured to cause the plurality of developer bearers to rotate in a same rotation period; and vary an output value of the developing bias in a same period as the rotation period based on a detection result by the rotation position detector.

11 Claims, 13 Drawing Sheets

(56) References Cited

U.S. PATENT DOCUMENTS

| | | | | |
|---|---|---|---|---|
| 2008/0292340 | A1* | 11/2008 | Watanabe | G03G 15/0194 399/49 |
| 2009/0047036 | A1 | 2/2009 | Hori et al. | |
| 2010/0003055 | A1 | 1/2010 | Kikuchi et al. | |
| 2010/0003058 | A1 | 1/2010 | Hori et al. | |
| 2010/0034557 | A1 | 2/2010 | Arai et al. | |
| 2010/0111572 | A1 | 5/2010 | Hori et al. | |
| 2010/0129118 | A1 | 5/2010 | Kimura et al. | |
| 2012/0201552 | A1 | 8/2012 | Hirai et al. | |
| 2012/0207492 | A1 | 8/2012 | Fujiwara et al. | |
| 2013/0045029 | A1 | 2/2013 | Kimura et al. | |
| 2013/0064570 | A1 | 3/2013 | Yamane et al. | |
| 2013/0243478 | A1 | 9/2013 | Okamoto et al. | |
| 2014/0064794 | A1 | 3/2014 | Takahashi et al. | |
| 2014/0270828 | A1 | 9/2014 | Suzuki et al. | |
| 2014/0376970 | A1 | 12/2014 | Kimura et al. | |
| 2015/0234318 | A1 | 8/2015 | Takahashi et al. | |
| 2016/0041498 | A1 | 2/2016 | Terai et al. | |
| 2016/0070208 | A1 | 3/2016 | Kikuchi et al. | |
| 2016/0170329 | A1 | 6/2016 | Kimura et al. | |
| 2016/0202630 | A1 | 7/2016 | Okamoto et al. | |
| 2016/0202660 | A1 | 7/2016 | Terai et al. | |
| 2017/0315471 | A1 | 11/2017 | Kamihara et al. | |

FOREIGN PATENT DOCUMENTS

| | | |
|---|---|---|
| JP | 2006-119310 | 5/2006 |
| JP | 2012-211937 | 11/2012 |
| JP | 2016-040634 | 3/2016 |

* cited by examiner

IMAGE FORMING APPARATUS, DEVELOPING DEVICE, AND IMAGE FORMING UNIT

CROSS-REFERENCE TO RELATED APPLICATION

This patent application is based on and claims priority pursuant to 35 U.S.C. § 119(a) to Japanese Patent Application No. 2018-028766, filed on Feb. 21, 2018, in the Japan Patent Office, the entire disclosure of which is hereby incorporated by reference herein.

BACKGROUND

Technical Field

The present disclosure relates to an image forming apparatus, and a developing device and an image forming unit mounted on the image forming apparatus.

Description of the Related Art

There are image forming apparatuses including a latent image bearer that bears a latent image and a developing device including a plurality of developer bearers that bears toner to develop the latent image on the latent image bearer. Some image forming apparatuses includes a common power source to output developing biases, which are periodically varied, to the plurality of developer bearers.

SUMMARY

According to an embodiment of this disclosure, an image forming apparatus includes a latent image bearer configured to bear a latent image and a developing device configured to develop the latent image on the latent image bearer with developer. The developing device includes a plurality of developer bearers configured to bear the developer. The image forming apparatus further includes a rotation position detector configured to detect a rotation position of at least one of the plurality of developer bearers, a common power source configured to apply a developing bias to each of the plurality of developer bearers, and circuitry configured to cause the common power source to periodically vary the developing bias. The circuitry is configured to cause the plurality of developer bearers to rotate in a same rotation period; and vary an output value of the developing bias in a same period as the rotation period based on a detection result by the rotation position detector.

According to another embodiment, a developing device includes a plurality of developer bearers configured to bear developer to develop a latent image on a latent image bearer. The plurality of developer bearers is to be rotated in a same rotation period and applied with a developing bias from a common power source. The developing device further includes a rotation position detector configured to detect a rotation position of at least one of the plurality of developer bearers. An output value of the developing bias is varied in a same period as the rotation period based on a detection result by the rotation position detector.

According to another embodiment, an image forming unit includes the latent image bearer configured to bear the latent image and the above-described developing device.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

Figure 1:
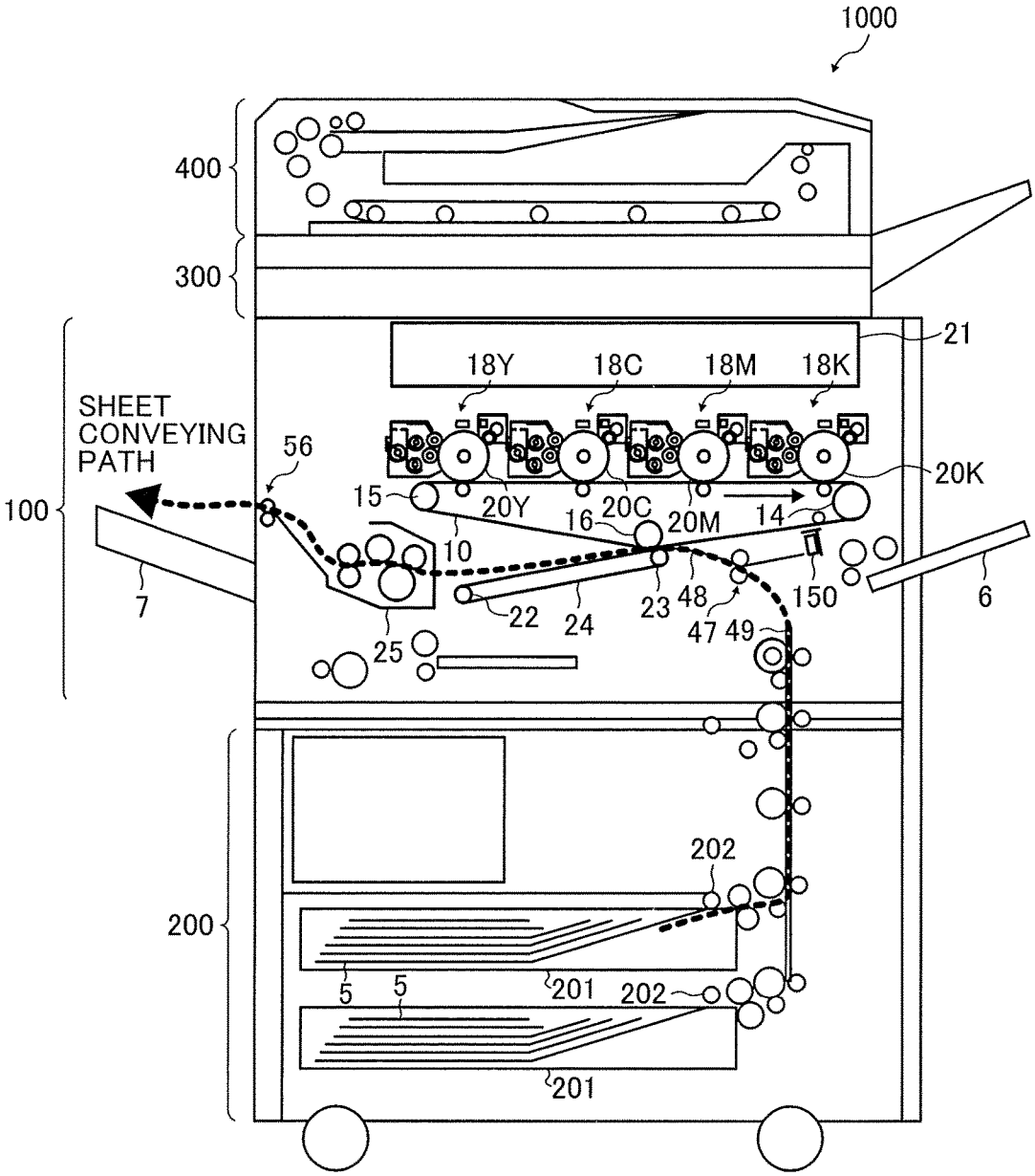
FIG. 1 is a schematic view illustrating a copier as an image forming apparatus according to an embodiment.

The accompanying drawings are intended to depict embodiments of the present invention and should not be interpreted to limit the scope thereof. The accompanying drawings are not to be considered as drawn to scale unless explicitly noted.

DETAILED DESCRIPTION

In describing embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

Referring now to the drawings, wherein like reference numerals designate identical or corresponding parts throughout the several views thereof, an image forming apparatus according to an embodiment of this disclosure is described. As used herein, the singular forms "a", "an", and "the" are intended to include the plural forms as well, unless the context clearly indicates otherwise.

First, a basic configuration of the image forming apparatus according to the embodiment, an example of which is an electrophotographic full-color copier (hereinafter simply referred to as a copier), will be described. FIG. 1 is a schematic configuration diagram illustrating the image forming apparatus according to the embodiment. In FIG. 1, an image forming apparatus 1000 includes an image forming section 100 that forms an image on a recording sheet, a sheet feeding device 200 that supplies a recording sheet 5 to the image forming section 100, a scanner 300 that reads an image of a document, and the like. Further, the image forming apparatus 1000 includes an automatic document feeder (ADF) 400 attached to a top of the scanner 300. The image forming section 100 is provided with a sheet feeding tray 6 for manually setting the recording sheet 5, a stack tray 7 for stacking the image-formed recording sheets 5, and the like.

The image forming section 100 includes image forming units 18Y, 18C, 18M, and 18K for forming toner images of yellow (Y), cyan (C), magenta (M), and black (K). Note that references Y, C, M, and K may be omitted when color discrimination is not necessary.

Peripheral surfaces of photoconductors 20Y, 20C, 20M, and 20K as latent image bearers of the image forming units 18Y, 18C, 18M, and 18K are uniformly charged by a charging device while the photoconductors 20Y, 20C, 20M, and 20K are rotationally driven in a counterclockwise direction in FIG. 1 by a driver.

A laser writing device 21 is provided above the image forming units 18Y, 18C, 18M, and 18K. The laser writing device 21 emits writing light on the basis of image information of a document read by the scanner 300 or image information sent from an external personal computer. Specifically, the laser writing device 21 drives a semiconductor laser by a laser controller to emit writing light L on the basis of the image information. Then, the peripheral surfaces of the drum-like photoconductors 20Y, 20C, 20M, and 20K after the uniform charging are exposed and scanned with the writing light L. With the exposure and scanning, exposed portions on the peripheral surfaces of the photoconductors 20Y, 20C, 20M, and 20K attenuate potentials and become yellow, cyan, magenta, and black electrostatic latent images. That is, the laser writing device 21 writes the yellow, cyan, magenta, and black electrostatic latent images on the peripheral surfaces of the photoconductors 20Y, 20C, 20M, and 20K. Note that a light source of the writing light L is not limited to a laser diode, and may be, for example, a light emitting diode (LED).

Figure 2:
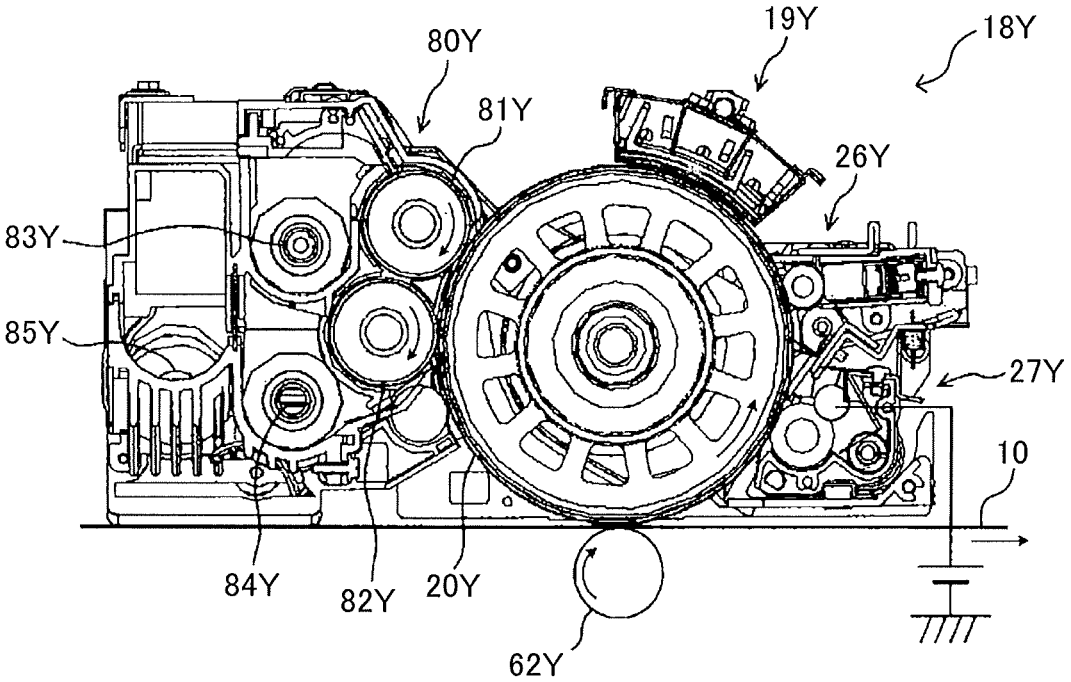
FIG. 2 is a cross-sectional view illustrating a yellow (Y) image forming unit in an image forming section of the copier illustrated in FIG. 1.

The image forming units 18Y, 18C, 18M, and 18K have a broadly similar configuration to one another except that colors of toners to be used are different. Taking the yellow image forming unit 18Y for forming a yellow toner image as an example, the yellow image forming unit 18Y includes the photoconductor 20Y, as illustrated in FIG. 2. Further, the yellow image forming unit 18Y includes a charging device 19Y as a charger, a developing device 80Y, a drum cleaning device 27Y, a lubricant coating device 26Y, and the like arranged around the photoconductor 20Y.

The photoconductor 20Y is rotationally driven in the arrow direction in FIG. 2 (in the counterclockwise direction in FIG. 2) by the driver. This rotating direction is a direction in which a surface of the photoconductor 20Y is moved in the same direction as a belt rotation direction at a contact position with an intermediate transfer belt 10. Further, the rotating direction is a direction in which the surface of the photoconductor 20Y is moved in the same direction as a surface of a first developing sleeve 81Y (an extreme upstream developer bearer) at a position facing the first developing sleeve 81Y of the developing device 80Y or is moved in the same direction as a surface of a second developing sleeve 82Y (an extreme downstream developer bearer) at a position facing the second developing sleeve 82Y.

The surface of the rotationally driven photoconductor 20Y is uniformly charged to the same polarity (negative polarity) as a charging polarity of the toner at a position facing the charging device 19Y. FIG. 2 illustrates, as the charging device 19Y, a charging device in a method of applying a charging bias to a wire extending in a rotation axis direction of the photoconductor 20Y while facing the photoconductor 20Y via a predetermined gap to charge the surface of the photoconductor 20Y by discharging between the wire and the surface of the photoconductor 20Y. Instead of the charging device in the method, a charging device in a method of applying a charging bias to a charging roller or a charging brush roller in contact with or in proximity to the surface of the photoconductor 20Y to charge the surface of the photoconductor 20Y by discharging between the roller or the brush roller and the surface of the photoconductor 20Y may be used. The charging device in either method prompts the discharging, adopting a charging bias made of a superimposed voltage by superimposition of an alternating current voltage and a direct current voltage in the same polarity as the charging polarity of the toner.

A developer containing a magnetic carrier and a yellow toner is accommodated inside the developing device 80Y and is circulated and conveyed in the developing device 80Y by three screws (83Y, 84Y, and 85Y). The first developing sleeve 81Y and the second developing sleeve 82Y as developer bearers are arranged side by side along a rotation direction of the photoconductor 20Y in the developing device 80Y. Each of these developing sleeves (81Y and 82Y) includes a magnet roller that is not rotatable with the developing sleeve. The developing sleeve has a plurality of magnetic poles aligned in a peripheral direction thereof, and the surface of the developing sleeve bears the developer in the developing device 80Y due to a magnetic force of the magnet roller.

The developer conveyed by a first agitating and conveying screw 83Y provided in the developing device 80Y is drawn up on the peripheral surface of the first developing sleeve 81Y and is then conveyed to a first developing region facing the photoconductor 20Y with the rotation of the first developing sleeve 81Y. An alternating current voltage and a developing bias of the same polarity (negative polarity) as the charging polarity of the toner are applied to the first developing sleeve 81Y.

An absolute value of the developing bias is larger than an absolute value of a potential (for example, −50 V) of the electrostatic latent image born by the photoconductor 20Y and is smaller than a potential (for example, −800 V) of a background portion of the photoconductor 20Y (a portion not the electrostatic latent image). Therefore, a non-developing potential for electrostatically moving the toner from the photoconductor 20Y side to the sleeve side acts on the toner between the first developing sleeve 81Y and the background portion of the photoconductor 20Y in the first developing region. Meanwhile, a developing potential for electrostatically moving the toner from the sleeve side to the photoconductor 20Y side acts on the toner between the first developing sleeve 81Y and the electrostatic latent image of the photoconductor 20Y. As a result, the toner with the negative polarity (for example, −30 μC/g) of the developer born by the first developing sleeve 81Y selectively adheres to the electrostatic latent image on the photoconductor 20Y to develop the electrostatic latent image.

The developer on the surface of the first developing sleeve 81Y, the developer having passed through the first developing region, is delivered to the surface of the second developing sleeve 82Y. Then, the developer is conveyed to the second developing region facing the photoconductor 20Y with the rotation of the second developing sleeve 82Y. Since the developing bias is also applied to the second developing sleeve 82Y, the developer on the second developing sleeve 82Y also develops the electrostatic latent image on the photoconductor 20Y.

By performing the development with the two developing sleeves (81Y and 82Y), the length of the developing region contributing to the development, that is, developing time is increased and developing efficiency can be enhanced. Note that the developing time can be increased by increasing the diameter of one developing sleeve, but such a configuration is not favorable because the developing device is increased in size and the dead space in the device is increased.

The developer on the second developing sleeve 82Y, the developer having passed through the second developing region, is separated from the second developing sleeve 82Y and collected by a second agitating and conveying screw 84Y in the developing device 80Y. Then, the developer is delivered from the second agitating and conveying screw 84Y to a third agitating and conveying screw 85Y and is then delivered from the third agitating and conveying screw 85Y to the first agitating and conveying screw 83Y.

Both the first developing sleeve 81Y and the second developing sleeve 82Y proximity to the first developing sleeve 81Y and arranged on the downstream side of the first developing sleeve 81Y in the rotation direction of the photoconductor 20Y are located on the left side of the photoconductor 20Y in FIG. 2 and rotate in a clockwise direction. As a result, the surfaces of the first developing sleeve 81Y and the second developing sleeve 82Y are moved in the same direction as the surface of the photoconductor 20Y in the developing regions that are regions facing the photoconductor 20Y.

Although the developing process in the yellow image forming unit 18Y has been described, the electrostatic latent images on the photoconductors (20C, 20M, and 20K) are similarly developed in the C, M, and K image forming units (18C, 18M, and 18K). As a result, yellow, cyan, magenta, and black toner images are formed on the photoconductors 20Y, 20C, 20M, and 20K.

Note that a first sleeve gear is secured to a rotation shaft of the first developing sleeve 81Y, and integrally rotates with the first developing sleeve 81Y. Further, a second sleeve gear is secured to a rotation shaft of the second developing sleeve 82Y, and integrally rotates with the second developing sleeve 82Y. An idler gear is interposed between and meshes with the first sleeve gear and the second sleeve gear. As a result, a rotational driving force of the first developing sleeve 81Y is transmitted to the second developing sleeve 82Y via the first sleeve gear, the idler gear, and the second sleeve gear. Since the first sleeve gear and the second sleeve gear have the same diameter and the same number of teeth, the first developing sleeve 81Y and the second developing sleeve 82Y integrally rotate at the same angular velocity.

In FIG. 2, a primary transfer roller 62Y arranged below the photoconductor 20Y sandwiches the intermediate transfer belt 10 with the photoconductor 20Y while being pressed against the photoconductor 20Y. As a result, a Y primary transfer nip by contact of the photoconductor 20Y and a front surface of the intermediate transfer belt 10 is formed. The toner image on the photoconductor 20Y enters the primary transfer nip with the rotation of the photoconductor 20Y and is primarily transferred to the front surface of the intermediate transfer belt 10.

A transfer residual toner that has not been primarily transferred to the intermediate transfer belt 10 adheres to the surface of the photoconductor 20Y that has passed through the aforementioned primary transfer nip. The transfer residual toner is removed from the surface of the photoconductor 20Y by the drum cleaning device 27Y.

Figure 3:
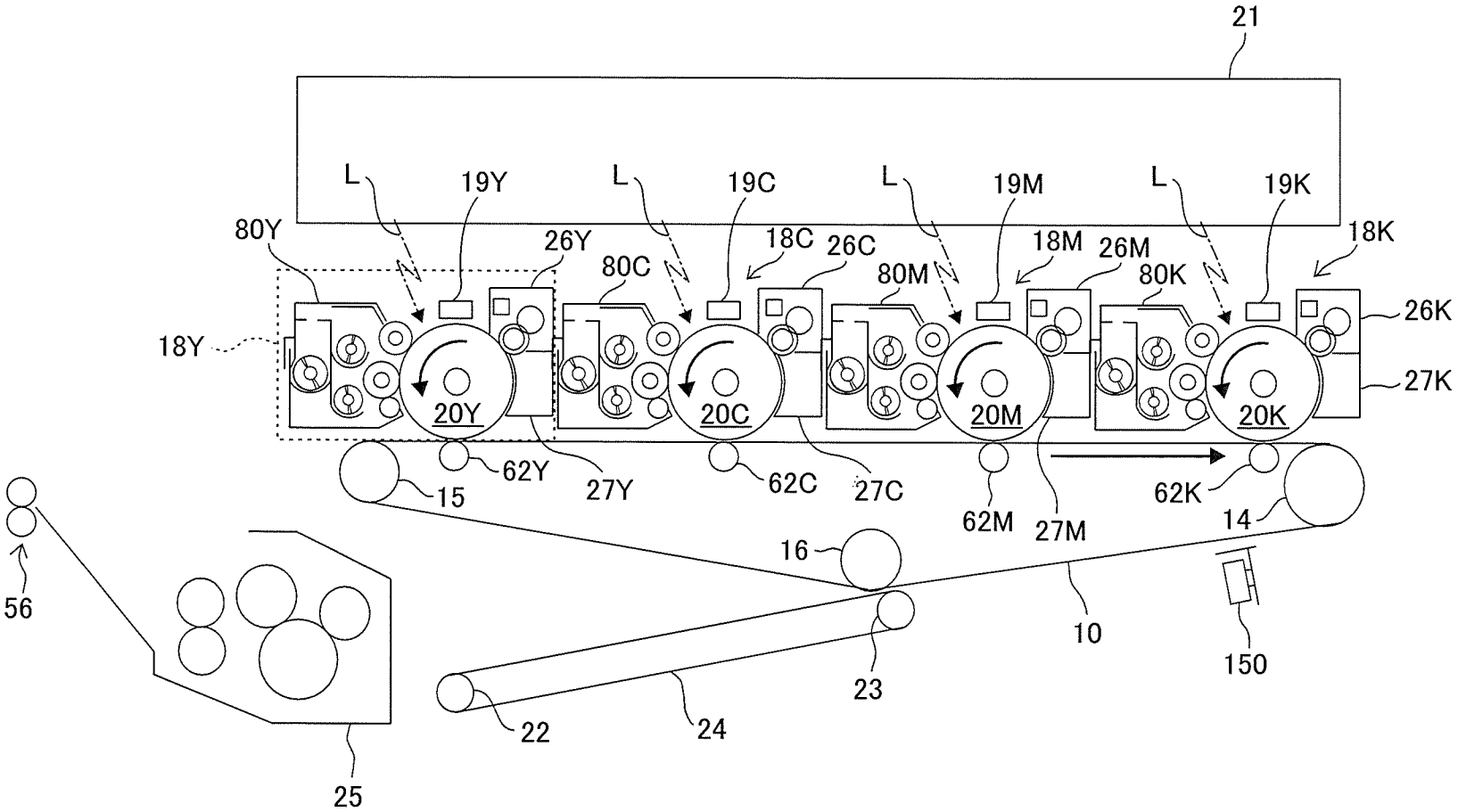
FIG. 3 is an enlarged cross-sectional view of the image forming section.

FIG. 3 is an enlarged view illustrating the image forming section 100. A transfer unit including the endless intermediate transfer belt 10 as a transfer body is provided below the image forming units 18Y, 18C, 18M, and 18K in the image forming section 100. The intermediate transfer belt 10 of the transfer unit is endlessly moved in the clockwise direction in FIG. 3 by one of three support rollers 14, 15, and 16 in a state of being stretched around the support rollers 14, 15, and 16.

The four image forming units of Yellow (Y), cyan (C), magenta (M), and black (K) face the front surface of the belt portion moving between the first support roller 14 and the second support roller 15 of the support rollers 14, 15, and 16. Further, an optical sensor unit 150 for detecting image density (a toner adhesion amount per unit area) of the toner image on the intermediate transfer belt 10 faces the front surface of the belt portion moving between the first support roller 14 and the third support roller 16.

yellow, cyan, magenta, and black primary transfer rollers 62Y, 62C, 62M, and 62K are arranged inside a loop of the intermediate transfer belt 10 and sandwich the intermediate transfer belt 10 with the yellow, cyan, magenta, and black photoconductors 20Y, 20C, 20M, and 20K. As a result, yellow, cyan, magenta, and black primary transfer nips in which the front surface of the intermediate transfer belt 10 and the yellow, cyan, magenta, and black photoconductors 20Y, 20C, 20M, and 20K are in contact with each other are formed. Primary transfer electrical fields are respectively formed between the yellow, cyan, magenta, and black primary transfer rollers 62Y, 62C, 62M, and 62K to which a primary transfer bias is applied and the photoconductors 20Y, 20C, 20M, and 20K.

The front surface of the intermediate transfer belt 10 sequentially passes through the yellow, cyan, magenta, and black primary transfer nips with the endless movement of the belt. In that process, the yellow, cyan, magenta, and black toner images on the photoconductors 20Y, 20C, 20M, and 20K are sequentially superimposed and primarily transferred on the front surface of the intermediate transfer belt 10. As a result, a four-color superimposed toner image is formed on the front surface of the intermediate transfer belt 10.

An endless conveyor belt 24 stretched by a first tension roller 22 and a second tension roller 23 is arranged below the intermediate transfer belt 10 and is endlessly moved in the counterclockwise direction in FIG. 3 with rotational driving of one of the tension rollers. Then, a front surface of the conveyor belt 24 is brought into contact with a portion of the intermediate transfer belt 10 where the intermediate transfer belt 10 is wound around the third support roller 16, of the entire region of the intermediate transfer belt 10, to form a secondary transfer nip. A secondary transfer electrical field is formed between the grounded second tension roller 23 and the third support roller 16 to which a secondary transfer bias is applied around the secondary transfer nip.

A conveyance path 48 for sequentially conveying the recording sheet 5 fed from the sheet feeding device 200 or the sheet feeding tray 6 to the secondary transfer nip, and a fixing device 25 and a discharge roller pair 56 to be described below is provided in the image forming section 100. Further, a feeding path 49 for conveying the recording sheet 5 fed from the sheet feeding device 200 to the image forming section 100 to an entrance of the conveyance path 48 is also provided. Note that a registration roller pair 47 is arranged at the entrance of the conveyance path 48.

When a print job is started, the recording sheet 5 fed out from the sheet feeding device 200 or the sheet feeding tray 6 is conveyed toward the conveyance path 48 and butts against the registration roller pair 47. Then, the registration roller pair 47 starts rotational driving at appropriate timing, thereby feeding the recording sheet 5 toward the secondary transfer nip. In the secondary transfer nip, the four-color superimposed toner image on the intermediate transfer belt 10 is brought into close contact with the recording sheet 5. Then, the four-color superimposed toner image is secondarily transferred to the surface of the recording sheet 5 to become a full-color toner image by an action of the secondary transfer electrical field and a nip pressure.

The recording sheet 5 having passed through the secondary transfer nip is conveyed toward the fixing device 25 by the conveyor belt 24. Then, the recording sheet 5 is pressurized and heated inside the fixing device 25, whereby the full-color toner image is fixed on the surface of the recording sheet 5. Thereafter, the recording sheet 5 is discharged from the fixing device 25 and then stacked on the stack tray 7 via the discharge roller pair 56.

The optical sensor unit 150 is arranged to face a region after passing through the K primary transfer nip before entering the secondary transfer nip, of the entire region in the peripheral direction of the intermediate transfer belt 10, via a predetermined gap below the intermediate transfer belt 10.

In the image forming apparatus 1000 according to the present embodiment, control called process control processing is regularly performed at predetermined timing in order to stabilize the image density over a long period regardless of environmental changes or the like. In the process control processing, a Y patch pattern image including a plurality of patchy yellow toner images is formed on the Y photoconductor 20Y, and the Y patch pattern image is transferred to the intermediate transfer belt 10. Each of the plurality of patchy yellow toner images is a toner adhesion amount detection toner image for detecting a yellow toner adhesion amount.

A controller 110, which will be described below, similarly forms C, M, and K patch pattern images on the photoconductors 20C, 20M, and 20K and transfers the C, M, and K patch pattern images to the intermediate transfer belt 10 so as not to overlap each other. Then, the toner adhesion amount (image density) of each toner image in each of the patch pattern images is detected by the optical sensor unit 150. Then, image forming conditions such as developing bias reference values that are reference values of the developing biases are individually adjusted for the image forming units 18Y, 18C, 18M, and 18K on the basis of the detection results.

The optical sensor unit 150 includes four reflective photosensors aligned at predetermined intervals in a belt width direction of the intermediate transfer belt 10. Each of the reflective photosensors outputs a signal according to light reflectance of the intermediate transfer belt 10 or the patchy toner image on the intermediate transfer belt 10. Three of the four reflective photosensors detect both specularly reflected light and diffusely reflected light on the belt surface and perform outputs according to respective light amounts so as to perform outputs according to the yellow toner adhesion amount, a C toner adhesion amount, and an M toner adhesion amount.

Figure 4:
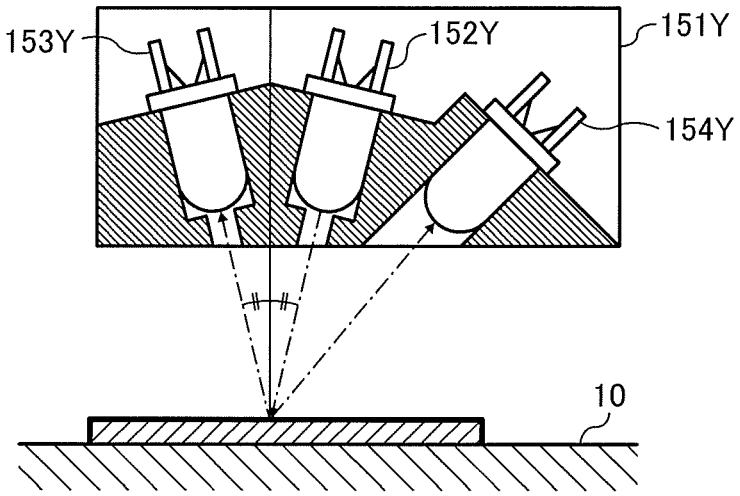
FIG. 4 is an enlarged view illustrating a reflective photosensor for yellow mounted on an optical sensor unit of the image forming apparatus illustrated in FIG. 1.

FIG. 4 is an enlarged view illustrating a reflective photosensor 151Y for yellow mounted on the optical sensor unit 150. The reflective photosensor 151Y for yellow includes an LED 152Y as a light source, a specular reflection-type light-receiving element 153Y for receiving the specularly reflected light, and a diffuse reflection-type light-receiving element 154Y for receiving the diffusely reflected light. The specular reflection-type light-receiving element 153Y outputs a voltage according to the amount of the specularly reflected light obtained on the surface of the Y patchy toner image. Further, the diffuse reflection-type light-receiving element 154Y outputs a voltage according to the amount of the diffusely reflected light obtained on the surface of the Y patchy toner image. The controller 110 can calculate the yellow toner adhesion amount of the Y patchy toner image on the basis of the voltages. Although the reflective photosensor 151Y for yellow has been described, the C and M reflective photosensors 151C and 151M have similar configurations to the configuration of the reflective photosensor 151Y for yellow and include the LED 152, the specular reflection-type light-receiving element 153, and the diffuse reflection-type light-receiving element 154.

Figure 5:
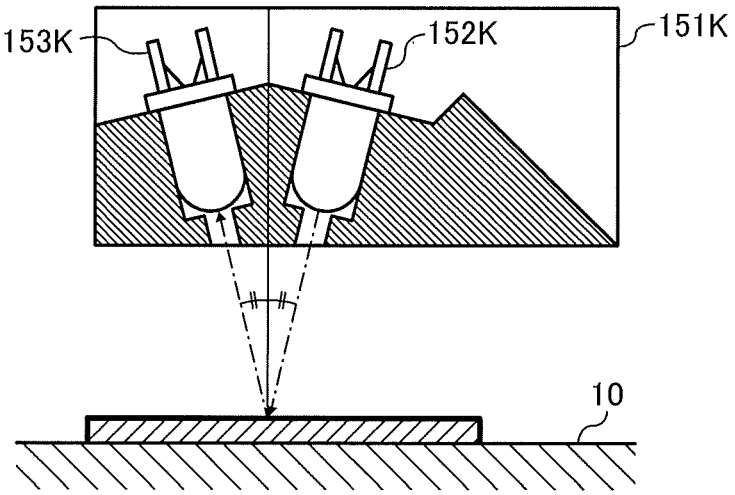
FIG. 5 is an enlarged view illustrating a reflective photosensor for black mounted on the optical sensor unit.

FIG. 5 is an enlarged view illustrating a reflective photosensor 151K for black mounted on the optical sensor unit 150. The reflective photosensor 151K for black includes an LED 152K as a light source and a specular reflection-type light-receiving element 153K for receiving the specularly reflected light. The specular reflection-type light-receiving element 153K outputs a voltage according to the amount of the specularly reflected light obtained on the surface of the K patchy toner image. The controller 110 can calculate the K toner adhesion amount of the K patchy toner image on the basis of the voltages.

As the LEDs (e.g., 152Y and 152K), a GaAs infrared light emitting diode having a peak wavelength of emitted light of 950 nm is used. Further, as the specular reflection-type light-receiving elements (e.g., 153Y and 153K) and the diffuse reflection-type light-receiving elements (e.g., 154Y), a Si phototransistor having peak light receiving sensitivity of 800 nm or the like is used. Note that the peak wavelength and the peak light receiving sensitivity are not limited to the above-described values.

A gap of about 5 [mm] is provided between the four reflective photosensors and the front surface of the intermediate transfer belt 10.

The controller 110 executes the process control processing at predetermined timing, such as at the time of turning on a main power source, at the time of standby after the elapse of a predetermined time, or at the time of standby after output of more than a predetermined number of prints. Then, when starting the process control processing, first, the controller 110 acquires environment information such as the number of passed sheets, a printing rate, a temperature, and a humidity, and then grasps development characteristics of each of the image forming units 18Y, 18C, 18M, and 18K. Specifically, the controller 110 calculates developing gamma y and a development start voltage for each of the colors. More specifically, the controller 110 uniformly charges the photoconductors 20Y, 20C, 20M, and 20K while rotating the photoconductors 20Y, 20C, 20M, and 20K. Regarding this charging, a charging bias different from a charging bias at the time of normal printing is output as the charging biases to be output from charging power sources 12Y, 12C, 12M, and 12K. Specifically, an absolute value of the direct current voltage, of the direct current voltage and the alternating current voltage of the charging bias made of the superimposed bias, is gradually increased rather than is kept to a constant value.

The photoconductors 20Y, 20C, 20M, and 20K charged under such conditions are scanned with the laser light by the laser writing device 21 to form a plurality of electrostatic latent images for the patchy yellow toner image, the patchy C toner image, the patchy M toner image, and the patchy K toner image. The plurality of electrostatic latent images is developed by the developing devices 80Y, 80C, 80M, and 80K to form the yellow, cyan, magenta, and black patch pattern images on the photoconductors 20Y, 20C, 20M, and 20K. At this time, the controller 110 gradually increases the absolute values of the developing biases to be applied to the first developing sleeve and the second developing sleeve of each color. Then, the controller 110 stores a difference between an electrostatic latent image potential and the developing bias in each patchy toner image in the RAM as the developing potential.

Figure 6:
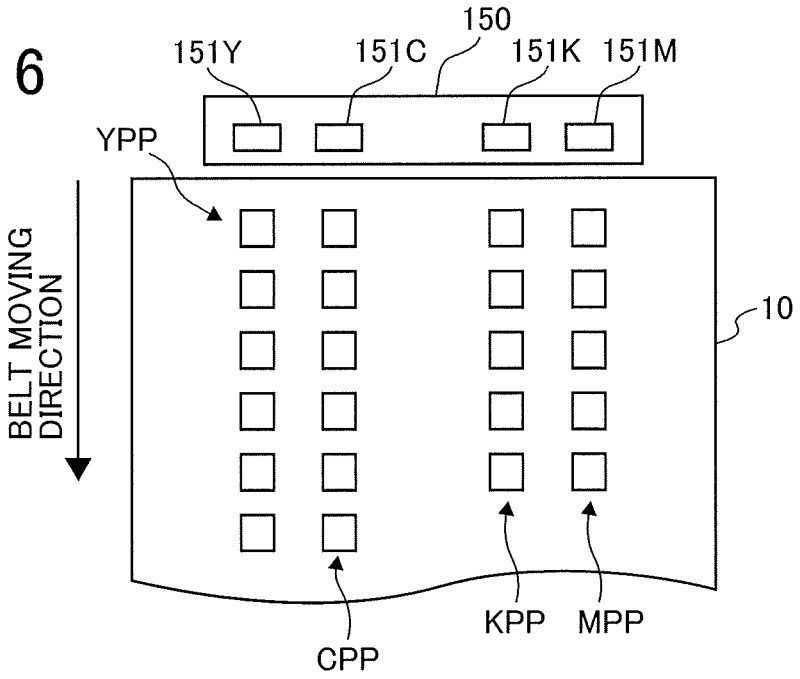
FIG. 6 is a schematic plan view illustrating a patch pattern image of colors transferred to an intermediate transfer belt of the image forming section illustrated in FIG. 3.

As illustrated in FIG. 6, the yellow, cyan, magenta, and black patch pattern images are arranged in the belt width direction so as not to overlap each other on the intermediate transfer belt 10. Specifically, a Y patch pattern image YPP is transferred to one end portion in the width direction of the intermediate transfer belt 10. Further, a C patch pattern image CPP is transferred to a position slightly shifted to a center side from the Y patch pattern image in the belt width direction. Further, an M patch pattern image MPP is transferred to the other end portion in the width direction of the intermediate transfer belt 10. Further, a K patch pattern image KPP is transferred to a position slightly shifted to a center side from the M patch pattern image in the belt width direction.

The optical sensor unit 150 includes the reflective photosensor 151Y for yellow that detects optical reflection characteristics at different positions from each other in the belt width direction. Further, the optical sensor unit 150 includes the C reflective photosensor 151C, the reflective photosensor 151K for black, and the M reflective photosensor 151M.

The reflective photosensor 151Y for yellow is arranged at a position for detecting the yellow toner adhesion amount of the Y patchy toner image of the Y patch pattern image YPP on the one end portion in the width direction of the intermediate transfer belt 10. Further, the C reflective photosensor 151C is arranged at a position for detecting the C toner adhesion amount of the C patchy toner image of the C patch pattern image CPP located near the Y patch pattern image YPP in the belt width direction. Further, the M reflective photosensor 151M is arranged at a position for detecting the M toner adhesion amount of the M patchy toner image of the M patch pattern image MPP on the other end portion in the width direction of the intermediate transfer belt 10. Further, the reflective photosensor for black 150C is arranged at a position for detecting the K toner adhesion amount of the K patchy toner image of the K patch pattern image KPP located near the M patch pattern image MPP in the belt width direction.

The controller 110 calculates the light reflectance of the patchy toner image of each color on the basis of output signals sequentially sent from the four reflective photosensors of the optical sensor unit 150 (an image density detector), and obtains and stores in the RAM the toner adhesion amount on the basis of the calculation amount. The patch pattern image of each color that has passed through the position facing the optical sensor unit 150 with traveling of the intermediate transfer belt 10 is cleaned from the front surface of the belt by a cleaning device.

Figure 7:
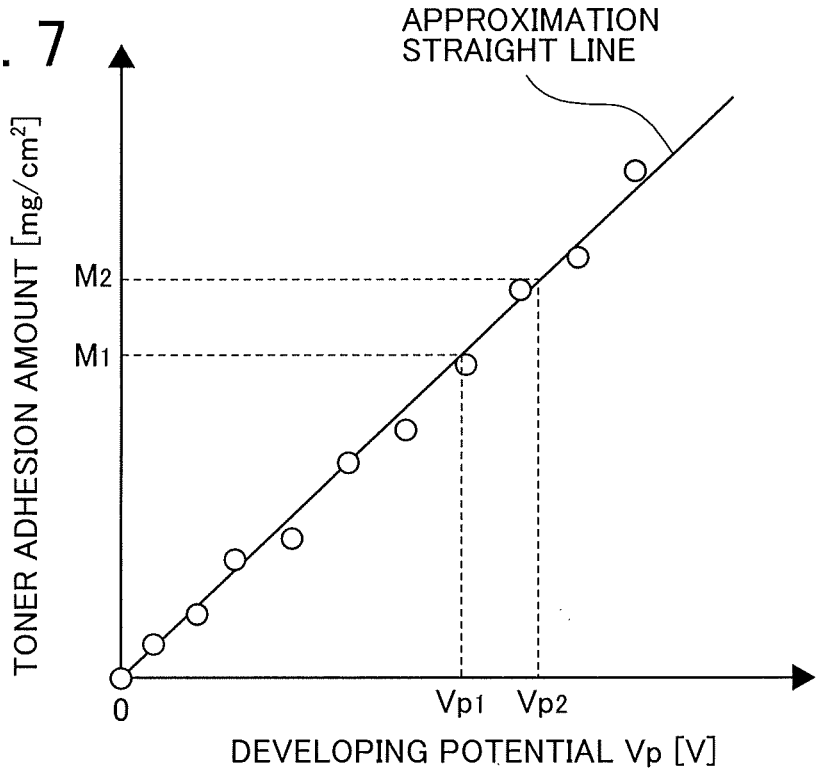
FIG. 7 is a graph illustrating an approximation linear equation of a relationship between a toner adhesion amount and a developing bias constructed by process control processing according to an embodiment.

Next, the controller 110 calculates a linear approximation equation ($Y=a\times Vp+b$) on the basis of the toner adhesion amount stored in the RAM, and data of a latent image potential and data of a developing bias Vb in each patch toner image separately stored in the RAM from the toner adhesion amount. Specifically, as illustrated in FIG. 7, the linear approximation equation is an approximation linear equation indicating a relationship between the toner adhesion amount on a y axis and the developing potential on an x axis in two-dimensional coordinates. Then, the controller 110 obtains a developing potential Vp that implements a target toner adhesion amount and obtains a developing bias reference value that is the developing bias Vb that implements the developing potential Vp, a charging bias reference value, (and laser diode power).

These results are stored in a non-volatile memory. The controller 110 calculates and stores the developing bias reference value and the charging bias reference value (and the laser diode power) for each of the yellow, cyan, magenta, and black and terminates the process control processing. Thereafter, in a print job, the controller 110 causes developing power sources 11Y, 11C, 11M, and 11K to output developing biases of values based on the developing bias reference values stored in the non-volatile memory, for yellow, cyan, magenta, and black. Further, the controller 110 causes the charging power sources 12Y, 12C, 12M, and 12K to output charging biases of values based on the charging bias reference values stored in the non-volatile memory.

By executing such process control processing and determining the developing bias reference values and the charging bias reference values that implement the target toner adhesion amount, the image density of the entire image can be stabilized over a long period of time for the yellow, cyan, magenta, and black.

As will be described in detail below, to suppress image density unevenness that increases and decreases in a developing sleeve rotation period during a print job, the controller 110 periodically varies output values of the developing biases from the developing power sources 11Y, 11C, 11M, and 11K (hereinafter "bias-output varying processing"). However, in the process control processing, development of each patch pattern image of each color is performed without periodically varying the output value of the developing bias. For this reason, the image density unevenness occurs in the patchy toner image of each color. To suppress deterioration of the detection accuracy of the toner adhesion amount caused by the image density unevenness, the toner adhesion amount is detected for each patchy toner image a plurality of times at predetermined time intervals, and an average value of the toner adhesion amounts is stored.

Next, the configuration of the image forming apparatus of the present embodiment will be further described.

Figure 8:
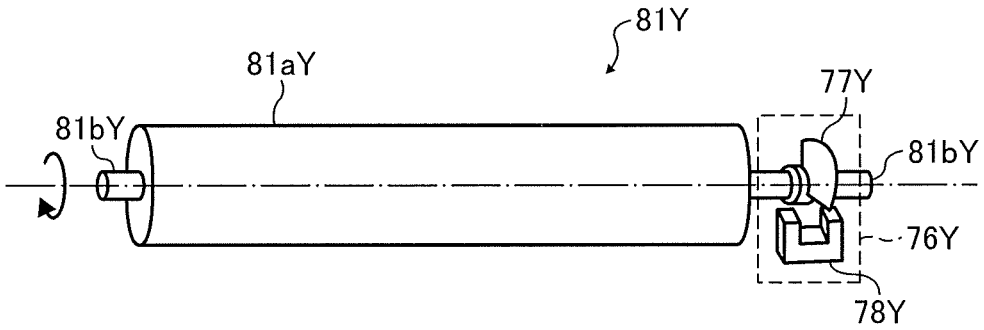
FIG. 8 is a perspective view illustrating a first developing sleeve in a yellow developing device of the image forming section.

FIG. 8 is a perspective view illustrating the first developing sleeve 81Y. The first developing sleeve 81Y includes a columnar roller 81*a*Y, rotation shafts 81*b*Y protruding in the rotation axis direction from both end surfaces of the roller 81*a*Y in the rotation axis direction, and the like.

One of the rotation shafts 81*b*Y respectively protruding from both end surfaces of the roller 81*a*Y penetrates a sleeve rotation sensor 76Y, and a portion protruding from the sleeve rotation sensor 76Y is received by a bearing. The sleeve rotation sensor 76Y includes a light shielding member 77Y secured to the rotation shaft 81*b*Y of the first developing sleeve 81Y and integrally rotating with the rotation shaft 81*b*Y, a transmission photosensor 78Y, and the like. The light shielding member 77Y has a shape protruding in a normal direction at a predetermined position on the peripheral surface of the rotation shaft 81*b*Y. Then, when the first developing sleeve 81Y takes a predetermined rotational position, the first developing sleeve 81Y lies between a light-emitting element and a light-receiving element of the transmission photosensor 78Y. As a result, the light-receiving element stops receiving light, so that an output voltage value from the transmission photosensor 78Y greatly decreases. That is, when the first developing sleeve 81Y takes a predetermined rotational position, the transmission photosensor 78Y detects the change in the posture and greatly lowers the output voltage value.

Figure 9:
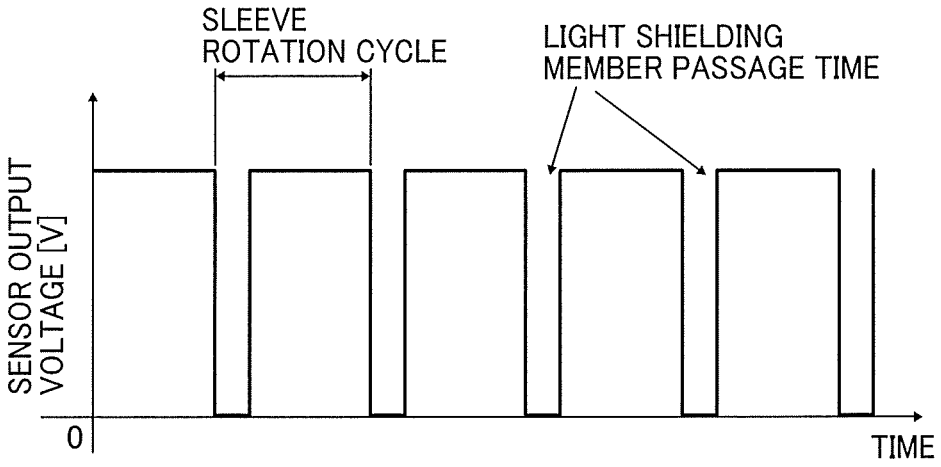
FIG. 9 is a graph illustrating change with time in an output voltage from a sleeve rotation sensor in the yellow developing device.

FIG. 9 is a graph illustrating change with time in the output voltage from the sleeve rotation sensor 76Y. Note that the output voltage from the sleeve rotation sensor 76Y is specifically the output voltage from the transmission photosensor 78Y. As illustrated in FIG. 9, when the first developing sleeve 81Y is rotating, a voltage of 6 [V] is output from the sleeve rotation sensor 76Y for most of the time. However, in each period (cycle) in which the first developing sleeve 81Y makes one round, the output voltage from the sleeve rotation sensor 76Y momentarily drops to near 0 [V]. This is because each time the first developing sleeve 81Y makes a round, the light shielding member 77Y lies between the light-emitting element and the light-receiving element of the transmission photosensor 78Y, so that the light-receiving element stops receiving light. The timing when the output voltage greatly drops is timing when the first developing sleeve 81Y has taken the predetermined rotational position. Hereinafter, this timing is referred to as reference position timing.

The sleeve rotation sensor 76Y functions as a rotation position detector that detects that the first developing sleeve 81Y has taken the predetermined rotational position. As described above, since the first developing sleeve 81Y and the second developing sleeve 82Y integrally rotate at the same rotational angular velocity (=rotation period), the sleeve rotation sensor 76Y also functions as the rotation position detector for the second developing sleeve 82Y.

Figure 10A:
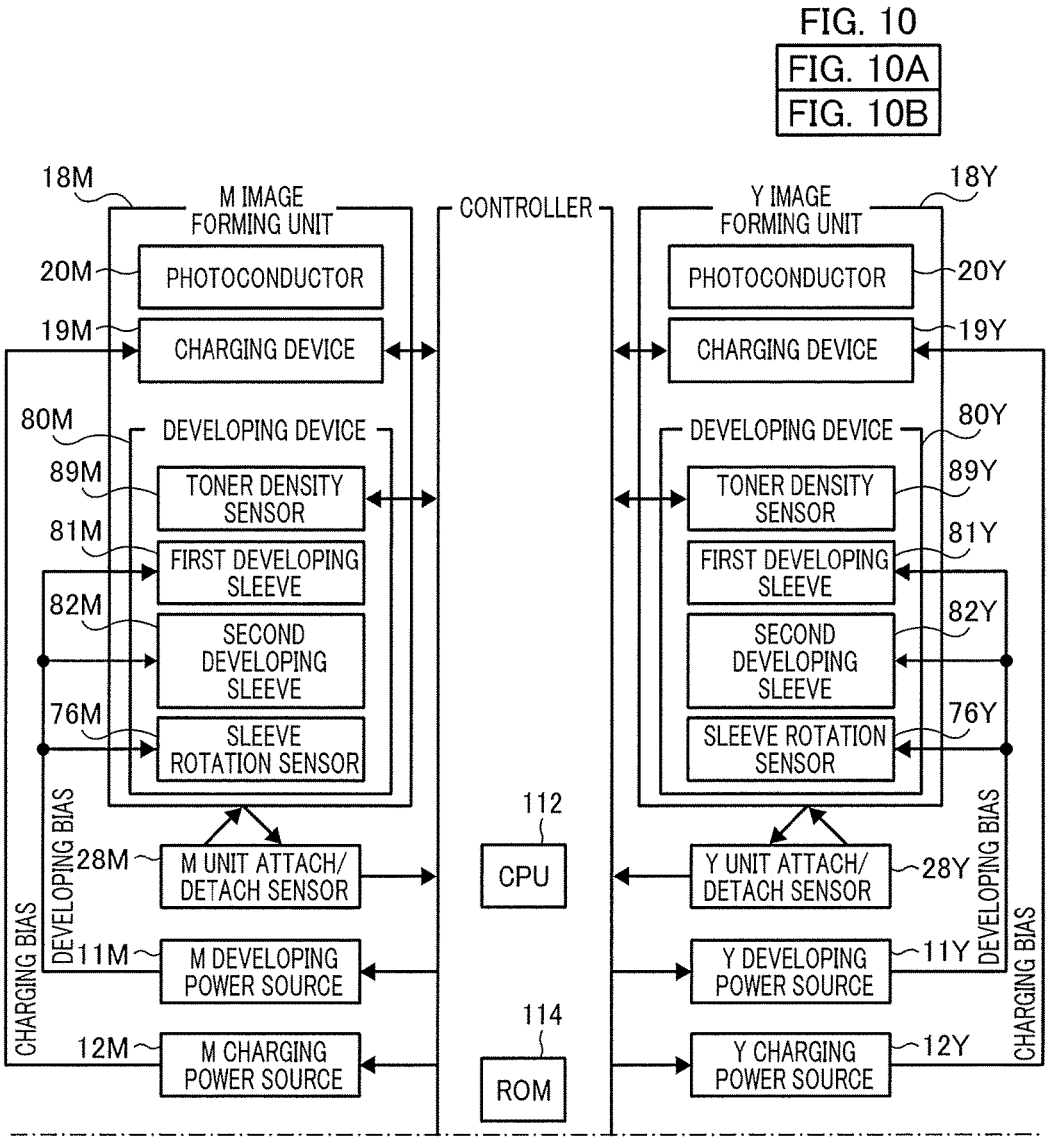
FIGS. 10A and 10B (FIG. 10) are block diagrams illustrating a main part of an electrical circuit of the copier, according to an embodiment.
Figure 10B:
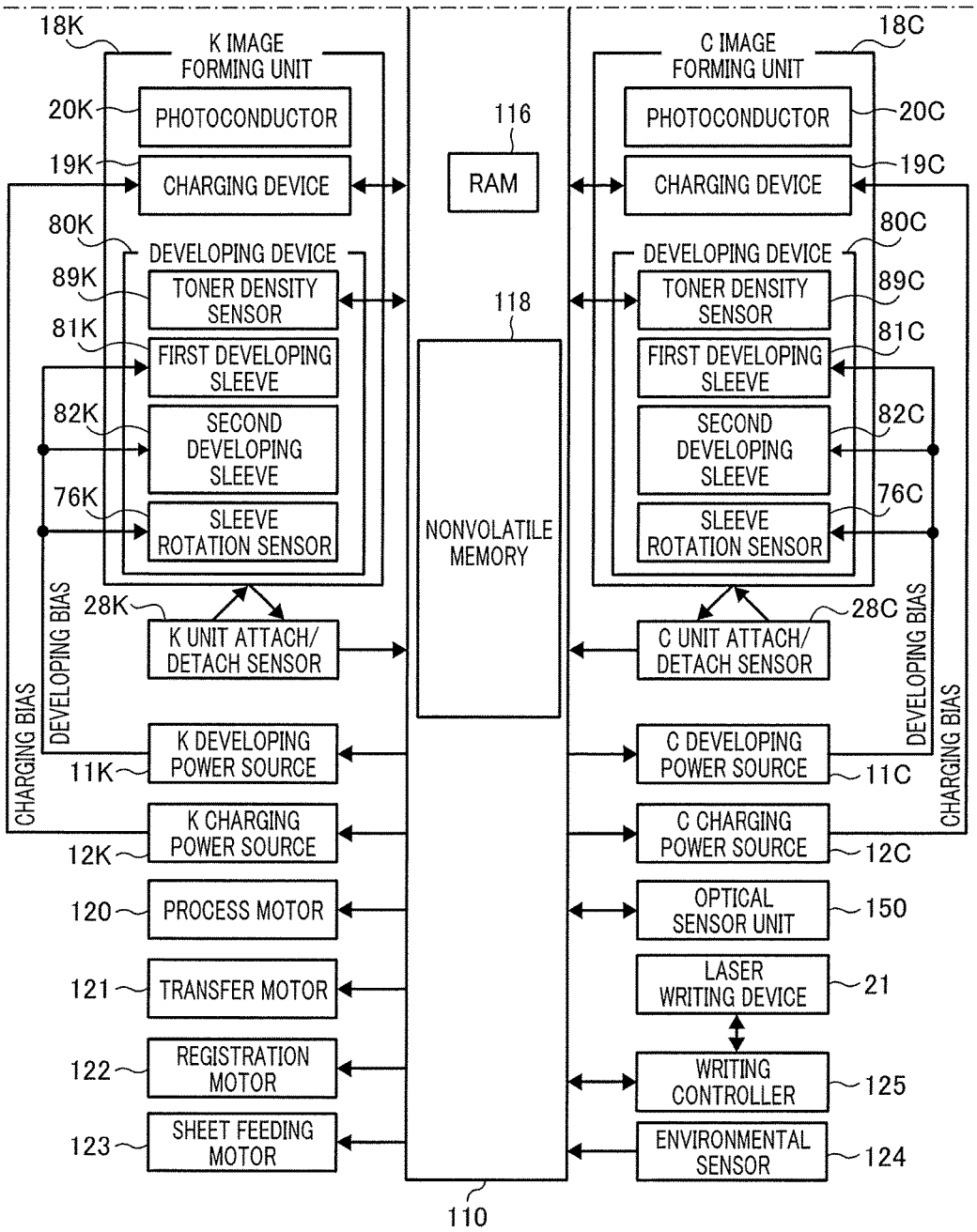

FIG. 10 is a block diagram illustrating a main part of an electrical circuit of the image forming apparatus of the present embodiment. In FIG. 10, the controller 110 includes a central processing unit (CPU) 112, a read only memory (ROM) 114, a random access memory (RAM) 116, a non-volatile memory 118, and the like. Toner density sensors 89Y, 89C, 89M, and 89K of developing devices 80Y, 80C, 80M, and 80K of the yellow, cyan, magenta, and black developing devices 80Y, 80C, 80M, and 80K are electrically connected to the controller 110. With the configuration, the controller 110 can grasp the toner density of the developer contained in the yellow, cyan, magenta, and black developing devices 80Y, 80C, 80M, and 80K.

Unit attach/detach sensors 28Y, 28C, 28M, and 28K for yellow, cyan, magenta, and black are also electrically connected to the controller 110. The unit attach/detach sensors 28Y, 28C, 28M, and 28K as attach/detach detectors can detect that the image forming units 18Y, 18C, 18M, and 18K have detached from the image forming section 100 and have attached to the image forming section 100. As a result, the controller 110 can grasp attachment or detachment of the image forming units 18Y, 18C, 18M, and 18K with respect to the image forming section 100.

Further, the developing power sources 11Y, 11C, 11M, and 11K for yellow, cyan, magenta, and black are also electrically connected to the controller 110. The controller 110 individually outputs control signals to the developing power sources 11Y, 11C, 11M, and 11K, thereby individually adjusting the values of the developing biases output from the developing power sources 11Y, 11C, 11M, and 11K. That is, the controller 110 can individually adjust the values of the developing biases to be applied to the combination (81Y and 82Y, 81C and 82C, 81M and 82M, or 81K and 82K) of the first developing sleeve and the second developing sleeve of each color.

Further, the charging power sources 12Y, 12C, 12M, and 12K for yellow, cyan, magenta, and black are also electrically connected to the controller 110. The controller 110 individually outputs control signals to the charging power sources 12Y, 12C, 12M, and 12K, thereby individually controlling the values of the direct current voltages in the charging biases output from the charging power sources 12Y, 12C, 12M, and 12K. That is, the controller 110 can individually adjust the values of the direct current voltages of the charging biases to be applied to the wires of the charging devices 19Y, 19C, 19M, and 19K for yellow, cyan, magenta, and black.

Further, the sleeve rotation sensors 76Y, 76C, 76M, and 76K for individually detecting that the first developing sleeves 81Y, 81C, 81M, and 81K have taken the predetermined rotational position are also electrically connected to the controller 110. The controller 110 can individually detect that the first developing sleeves 81Y, 81C, 81M, and 81K have taken the predetermined rotational position on the basis of the outputs from the sleeve rotation sensors 76Y, 76C, 76M, and 76K.

A writing controller 125, the optical sensor unit 150, a process motor 120, a transfer motor 121, a registration motor 122, a sheet feeding motor 123, and the like are also electrically connected to the controller 110. The process motor 120 is a motor serving as a drive source of the image forming units 18Y, 18C, 18M, and 18K. Further, the transfer motor 121 is a motor serving as a drive source of the intermediate transfer belt 10. Further, the registration motor 122 is a motor serving as a drive source of the registration roller pair 47. Further, the sheet feeding motor 123 is a motor serving as a drive source of a pickup roller 202 for sending the recording sheet 5 from a sheet feeding tray 201 of the sheet feeding device 200. Further, the writing controller 125 controls driving of the laser writing device 21 on the basis of image information.

The image density unevenness that increases and decreases in the developing sleeve rotation period occurs in the yellow, cyan, magenta, and black toner images. The image density unevenness is caused by eccentricity of a developing sleeve, first gap variation, second gap variation, a slight distortion of the developing sleeve surface, electrical resistance unevenness in the peripheral direction of a developing sleeve, and the like. The first gap variation is variation of the gap between each of the photoconductors 20Y, 20C, 20M, and 20K and corresponding one of the first developing sleeves 81Y, 81C, 81M, and 81K. Further, the second gap variation is variation of a developing gap between each of the photoconductors 20Y, 20C, 20M, and 20K and corresponding one of the second developing sleeves 82Y, 82C, 82M, and 82K. Since the developing sleeve rotation period is short, the image density unevenness appears at short intervals in a page in a sub-scanning direction (photoconductor rotation direction) and becomes conspicuous.

Specifically, the image density unevenness occurs as follows. That is, if the rotational axes of the first developing sleeves 81Y, 81C, 81M, and 81K are eccentric, the gap varies, exhibiting a sine curve-like curve, per rotation of the sleeve. As a result, the intensity of electrical field varies, exhibiting a sine curve-like curve, per rotation of the sleeve in a developing electrical field between the photoconductors 20Y, 20C, 20M, and 20K and the first developing sleeves 81Y, 81C, 81M, and 81K. The image density unevenness exhibiting a sine curve-like variation curve per rotation of the sleeve occurs due to the field intensity variation. Further, a distortion considerably occurs in external forms of the first developing sleeves 81Y, 81C, 81M, and 81K. Image density unevenness caused by periodic gap variation of a characteristic having the same pattern per rotation of the sleeve according to the distortion also occurs. Further, periodic image density unevenness due to the electrical resistance unevenness in the rotation direction of the first developing sleeves 81Y, 81C, 81M, and 81K also occurs.

Although the periodic image density unevenness occurring in the first developing region with the rotation of the first developing sleeves 81Y, 81C, 81M, and 81K has been described, the periodic image density unevenness with the rotation of the second developing sleeves 82Y, 82C, 82M, and 82K similarly occurs in the second developing region.

Therefore, the controller 110 performs following bias-output varying processing for each of the yellow, cyan, magenta, and black at the time of a print job. That is, the controller 110 stores, in the non-volatile memory, output pattern data of the developing bias for causing developing field intensity variation capable of offsetting the periodic image density unevenness that occurs with the rotation of the sleeve, for each of the yellow, cyan, magenta, and black. Hereinafter, this output pattern data is referred to as bias variation data.

Four bias variation data individually corresponding to yellow, cyan, magenta, and black indicate patterns with reference to the reference position timing of the first developing sleeves 81Y, 81C, 81M, and 81K. These bias variation data are used to change the outputs of the developing biases from the developing power sources (11Y, 11C, 11M, and 11K) with reference to the yellow, cyan, magenta, and black developing bias reference values determined in the process control processing. For example, in the case of data table-type data, a data group indicating development bias output differences at predetermined time intervals is stored within a period of one sleeve rotation from the reference position timing. Head data of the data group indicates the developing bias output difference from the reference value at the reference position timing, and second, third, and fourth data, and the like indicate the developing bias output differences at predetermined time intervals after the reference position timing. The output pattern made of the data group of 0, −5, −7, −9, and the like indicates that the development bias output differences are 0 [V], −5 [V], −7 [V], −9 [V], and the like at the reference position timing and subsequent timings at the predetermined intervals.

The controller 110 reads data from the bias variation data individually corresponding to yellow, cyan, magenta, and black at predetermined time intervals in image forming processing. In this data reading, in a case where the reference position timing does not arrive even when the last data in the data group is read, read values are set to the same value as the last data until arrival of the reference position timing. Further, in a case where the reference position timing arrives before the last data in the data group is read, a reading position of data is returned to the initial data.

The controller 110 adds the result of the data reading to the developing bias reference value and controls the developing power source to output the developing bias of the value after addition, for each of yellow, cyan, magenta, and black. The controller 110 performs such processing at predetermined time intervals for each of yellow, cyan, magenta, and black.

By the processing, the field intensity can be varied to decrease the periodic image density unevenness that occurs with the sleeve rotation, in the developing electrical field between the photoconductors 20Y, 20C, 20M, and 20K and the first developing sleeves 81Y, 81C, 81M, and 81K. With the generation of the field intensity variation, the image density unevenness occurring in the sleeve rotation period with the rotation of the first developing sleeves 81Y, 81C, 81M, and 81K can be suppressed regardless of the rotational positions of the first developing sleeves 81Y, 81C, 81M, and 81K. Similarly, the image density unevenness occurring in the sleeve rotation period with the rotation of the second developing sleeves 82Y, 82C, 82M, and 82K can be suppressed.

As the developing power source for outputting the developing bias, if a developing power source dedicated for outputting the developing bias to be applied to the first developing sleeve 81Y and a developing power source dedicated for outputting the developing bias to be applied to the second developing sleeve 82Y are provided, the cost increases. In addition, as the sleeve rotation sensor, if two sleeve rotation sensors for detecting the rotational position of the first developing sleeve 81Y and for detecting the rotational position of the second developing sleeve 82Y are provided, the cost increases. Furthermore, as the controller for controlling the outputs of the developing power sources on the basis of a monitoring result while individually monitoring the outputs from the respective sleeve rotation sensors, if an expensive controller capable of high-speed processing is provided, the cost increases.

Therefore, in the image forming apparatus 1000 according to the present embodiment, the developing bias output from one developing power source 11Y and periodically varying is applied to the first developing sleeve 81Y and the second developing sleeve 82Y, as illustrated in FIG. 10. With such a configuration, the increase in cost due to provision of a plurality of developing power sources can be avoided. In addition, since the sleeve rotation sensor 76Y that detects the rotational position of the first developing sleeve 81Y alone is provided as the sleeve rotation sensor, the increase in cost due to provision of a plurality of sleeve rotation sensors can be avoided. Furthermore, since there is no need to individually monitor outputs from a plurality of sleeve rotation sensors, the increase in cost due to adoption of the expensive controller capable of high-speed processing can be avoided. The same applies to C, M, and K.

As described above, there are the periodic image density unevenness occurring with the rotation of the first developing sleeve 81Y and the periodic image density unevenness occurring with the rotation of the second developing sleeve 82Y. Unevenness in which the image density unevenness and the image density unevenness are superimposed appears in an image in the end.

Figure 11:
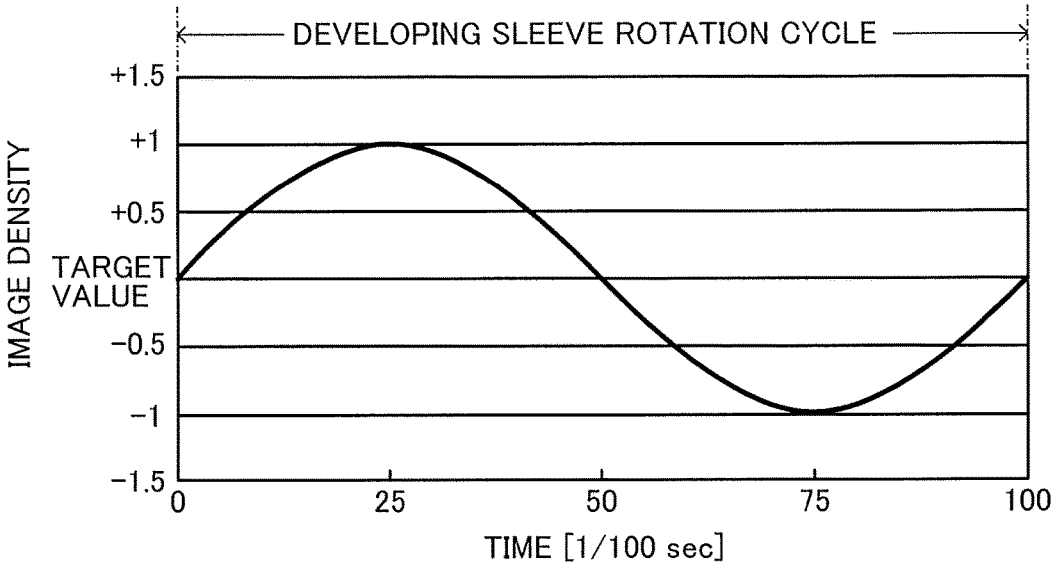
FIG. 11 is a graph illustrating an example of image density unevenness in a sleeve rotation period caused by eccentricity of the first developing sleeve.

FIG. 11 is a graph illustrating an example of the image density unevenness in the sleeve rotation period (rotation cycle) caused by eccentricity of the first developing sleeve 81Y. The vertical axis in FIG. 11 represents the image density, and the target value in FIG. 11 represents target image density. The image density unevenness coinciding with the rotation period of the first developing sleeve 81Y caused by the eccentricity of the first developing sleeve 81Y generally occurs with a pattern drawing one sine wave per rotation of the sleeve, as illustrated in FIG. 11. At a mountain-side peak of the sine wave, the image density is higher than the target value, whereas at a valley-side peak, the image density is lower than the target value. This sinusoidal image density unevenness occurs at each rotation of the first developing sleeve 81Y. The image density unevenness in the sleeve rotation period, which occurs with the rotation of the second developing sleeve 82Y caused by the eccentricity of the second developing sleeve 82Y is similar, but the amplitude may differ from the amplitude of the first developing sleeve 81Y.

In the example illustrated in FIG. 11, assume that the developing bias is varied to exhibit a variation curve that increases and decreases, in the sleeve rotation period, in the phase opposite the phase of the waveform of the image density unevenness. Then, in the first developing region, the intensity variation of the developing electrical field according to the rotational position of the first developing sleeve 81Y is offset by the intensity variation of the developing electrical field due to the variation of the developing bias, thereby making the intensity of the developing electrical field be substantially constant regardless of the rotational position of the first developing sleeve 81Y. As a result, the image density unevenness that increases and decreases in the sleeve rotation period with the rotation of the first developing sleeve 81Y can be substantially eliminated.

The image density unevenness that increases and decreases in the sleeve rotation period with the rotation of the second developing sleeve 82Y can also be similarly suppressed. Note that, in the image forming apparatus 1000, the developing bias is output from the common developing power source 11Y to the first developing sleeve 81Y and the second developing sleeve 82Y. For this reason, developing biases dedicated to waveforms of image density unevenness are not individually applied to the respective developing sleeves.

Hereinafter, for the sake of convenience, description will be given on the assumption that the image density unevenness in the sleeve rotation period, which occurs with the rotation of the developing sleeve, can be made zero in a case where a developing bias having a waveform of the same amplitude as the waveform of the image density unevenness and in an opposite phase to the waveform of the image density unevenness is applied to the developing sleeve.

Figure 12:
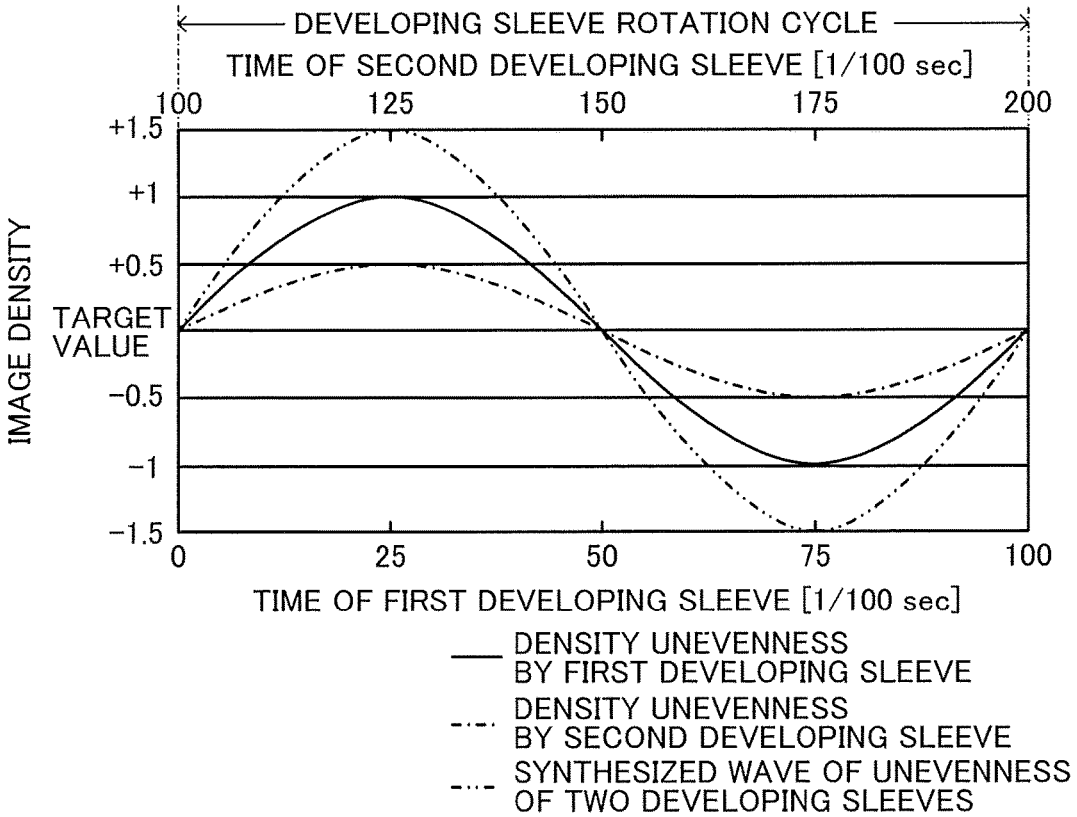
FIG. 12 is a graph illustrating a first example of waveforms of image density unevenness generated in two developing regions in the image forming unit and a synthesized wave of the waveforms.

FIG. 12 is a graph illustrating a first example of waveforms of image density unevenness generated in two developing regions and a synthesized wave of the waveforms. This graph illustrates image density unevenness in the following image forming unit. That is, in the image forming unit, the first developing sleeve and the second developing sleeve are assembled in the developing device such that timing of peak density position of the first developing sleeve coincides with timing of peak density position of the second developing sleeve. The peak density position is a rotational position of the developing sleeve at which the mountain-side peak appears in the image density unevenness waveform. Hereinafter, assembling the first developing sleeve and the second developing sleeve in the developing device under the above condition is referred to as making the sleeve rotational phases coincident with each other. Further, assembling the first developing sleeve and the second developing sleeve into the developing device under a condition that the former timing and the latter timing are shifted from each other is referred to as shifting the sleeve rotational phases from each other.

In FIG. 12, the image density unevenness by the first developing sleeve is the image density unevenness in the sleeve rotation period, which occurs with the rotation of the first developing sleeve. Further, the image density unevenness by the second developing sleeve is the image density unevenness in the sleeve rotation period, which occurs with the rotation of the second developing sleeve. A time axis of the image density unevenness by the first developing sleeve is represented by the lower X axis in the graph frame. Further, a time axis of the image density unevenness by the second developing sleeve is represented by the upper X axis in the graph frame.

Figure 13:
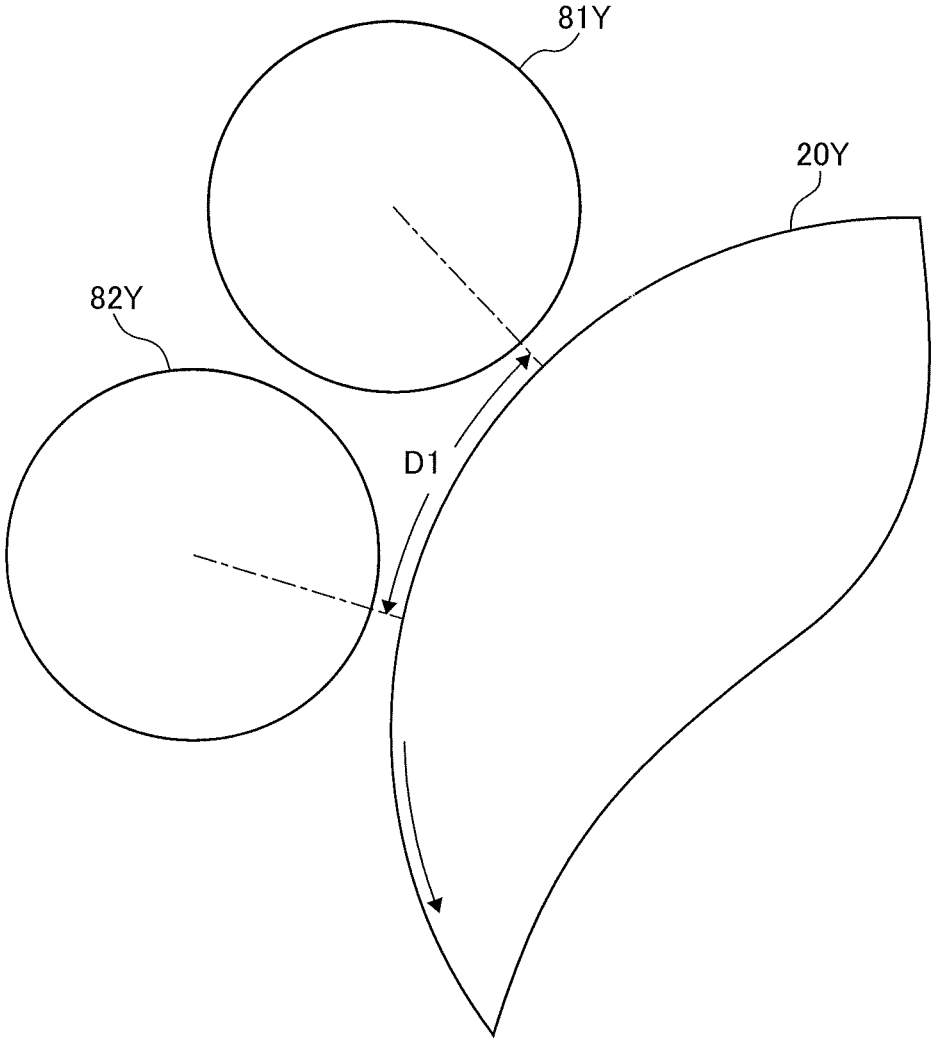
FIG. 13 is a schematic diagram for describing a sleeve arrangement distance of the image forming unit.

In an X axis direction, 0 [1/100 sec] on the time axis of the image density unevenness by the first developing sleeve and 100 [1/100 sec] on the time axis of the image density unevenness by the second developing sleeve are at the same position. This means that an image portion developed at the time of 0 [1/100 sec] by the first developing sleeve 81Y is developed again at the time of 100 [1/100 sec] by the second developing sleeve 82Y. The rotation periods of the two developing sleeves are the same and 100 [1/100 sec]. Therefore, the distance between the first developing sleeve and the second developing sleeve on the surface of the photoconductor (hereinafter referred to as sleeve arrangement distance) and the distance by which photoconductor rotates in one sleeve rotation period (hereinafter referred to as photoconductor rotation distance in one sleeve rotation) are the same. As illustrated in FIG. 13, the sleeve arrangement distance is a distance D1 between a position nearest to the first developing sleeve 81Y and a position nearest to the second developing sleeve 82Y on the surface of the photoconductor 20Y.

In the configuration in which the rotational phases of the two developing sleeves are made coincident with each other and the sleeve arrangement distance is set to the photoconductor rotation distance in one sleeve rotation, the waveform of the image density unevenness by the first developing sleeve overlap with the waveform of the image density unevenness by the second developing sleeve in the same phase at the second position, as illustrated in FIG. 12. Since the amplitude of the waveform of the image density unevenness by the second developing sleeve is half the amplitude of the waveform of the image density unevenness by the first developing sleeve, the amplitude of a synthesized wave is 1.5 times the waveform of the image density unevenness by the first developing sleeve. The phase of this synthesized wave is in phase with the waveform of the image density unevenness by the first developing sleeve and the waveform of the image density unevenness by the second developing sleeve.

Assume that the graph is created under a condition that a deviation amount from the target value of the image density and a deviation amount from the reference value of the developing bias for correction (positive and negative polarities are opposite to the former deviation amount) are set to the same value (absolute value) on the same graph. Then, in the example of FIG. 12, if the developing bias is varied with a pattern with the amplitude that is ½ the amplitude of the synthesized wave and in an opposite phase to the synthesized wave, the occurrence of the image density unevenness that increases and decreases in the sleeve rotation period can be avoided. The phase of this developing bias is indicated by the time axis based on the timing when the surface of the photoconductor enters the first developing region. Description will be given on the assumption that the developing bias is varied with the above pattern.

Figure 14:
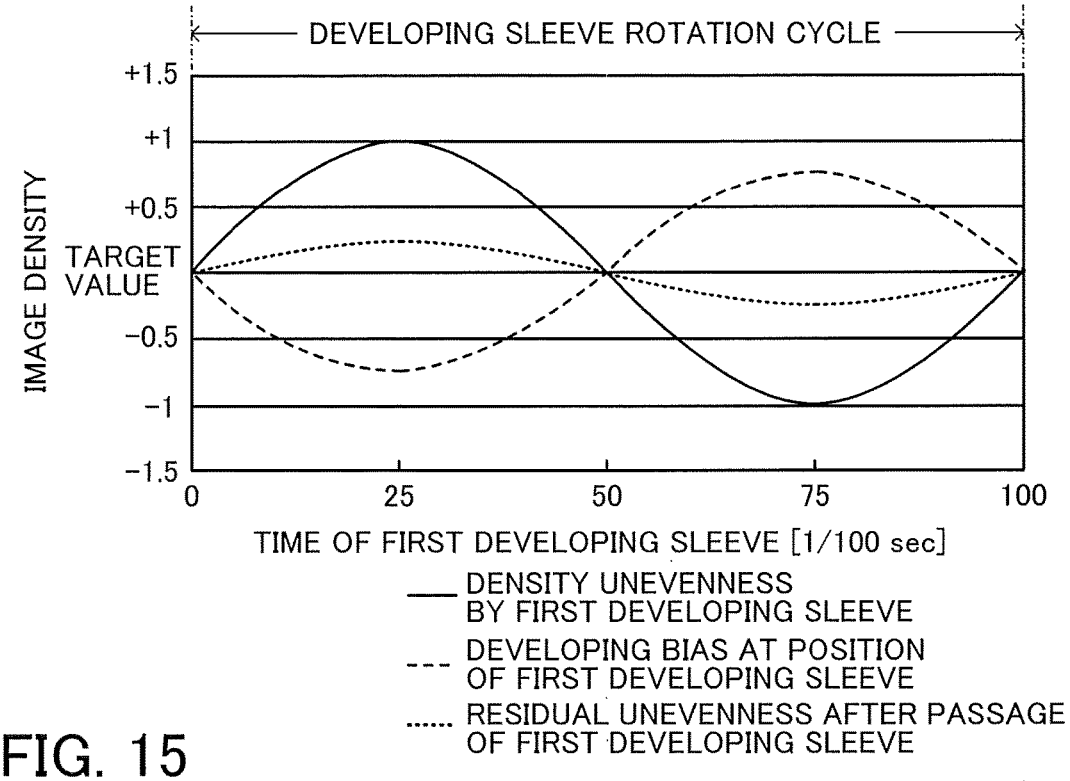
FIG. 14 is a graph illustrating various waveforms related to the first developing sleeve in a case where sleeve rotational phases are made coincident with each other and the sleeve arrangement distance and a sleeve one period moving distance of a photoconductor are set to be the same.

FIG. 14 is a graph illustrating various waveforms related to the first developing sleeve in a case where sleeve rotational phases are made coincident with each other and the sleeve arrangement distance and the photoconductor rotation distance in one sleeve rotation are set to be the same. In the first developing region, a valley-side peak value of a varied waveform of the developing bias is caused to appear at timing when a mountain-side peak value of the waveform of the image density unevenness by the first developing sleeve is caused to appear. If absolute values of both the peak values are the same, the image density can be made to the target value. However, since the absolute value of the valley-side peak value is 0.75 times the absolute value of the mountain-side peak value, density deviation of 0.25 remains. That is, the waveform of residual unevenness after passage of the first developing sleeve becomes a waveform having the same phase and the amplitude decreased by 0.25 times with respect to the waveform of the image density unevenness by the first developing sleeve.

Figure 15:
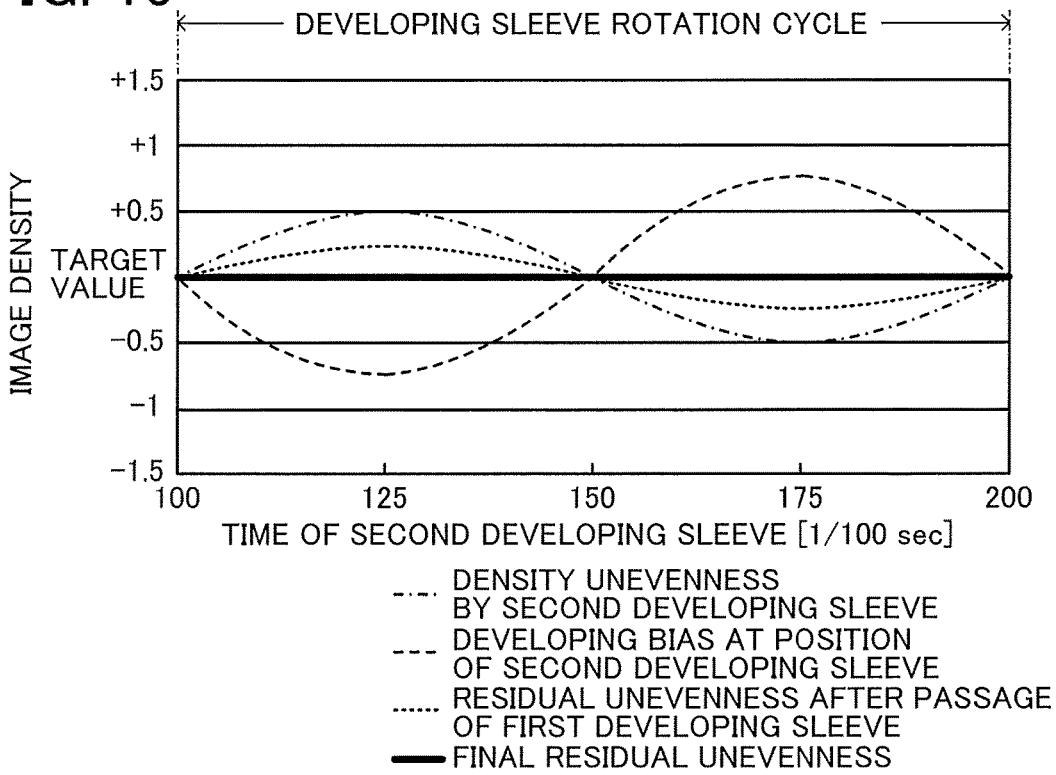
FIG. 15 is a graph illustrating various waveforms related to a second developing region in a case where the sleeve rotational phases are made coincident with each other and the sleeve arrangement distance and the sleeve one period moving distance of a photoconductor are set to be the same.

FIG. 15 is a graph illustrating various waveforms related to a second developing region in a case where the sleeve rotational phases are made coincident with each other, and the sleeve arrangement distance and the sleeve one period moving distance of a photoconductor are set to be the same. In this case, in the second developing region, the waveform (amplitude=0.5) of the image density unevenness by the second developing sleeve and the waveform (amplitude=0.25) of the residual unevenness after passage of the first developing sleeve are superimposed in opposite phase with the varied waveform (amplitude=0.75) of the developing bias. With the superimposition, the waveform of the image density unevenness by the second developing sleeve and the waveform of the residual unevenness after passage of the first developing sleeve are offset by the varied waveform of the developing bias, and final residual unevenness can be eliminated. That is, the occurrence of the image density unevenness in the sleeve rotation period with the rotation of the first developing sleeve and the second developing sleeve can be avoided.

Even if the sleeve rotational phases are made coincident with each other, the waveform of the final residual unevenness is different from the waveform of the final residual unevenness illustrated in FIG. 15 unless the sleeve arrangement distance and the photoconductor rotation distance in one sleeve rotation are set to the same. The inventor of the present invention conducted with a personal computer a simulation to investigate the degree of overlapping of various waveforms by variously changing the deviation amount of the sleeve arrangement distance from the photoconductor rotation distance in one sleeve rotation under the condition that the sleeve rotational phases are made coincident with each other.

Figure 16:
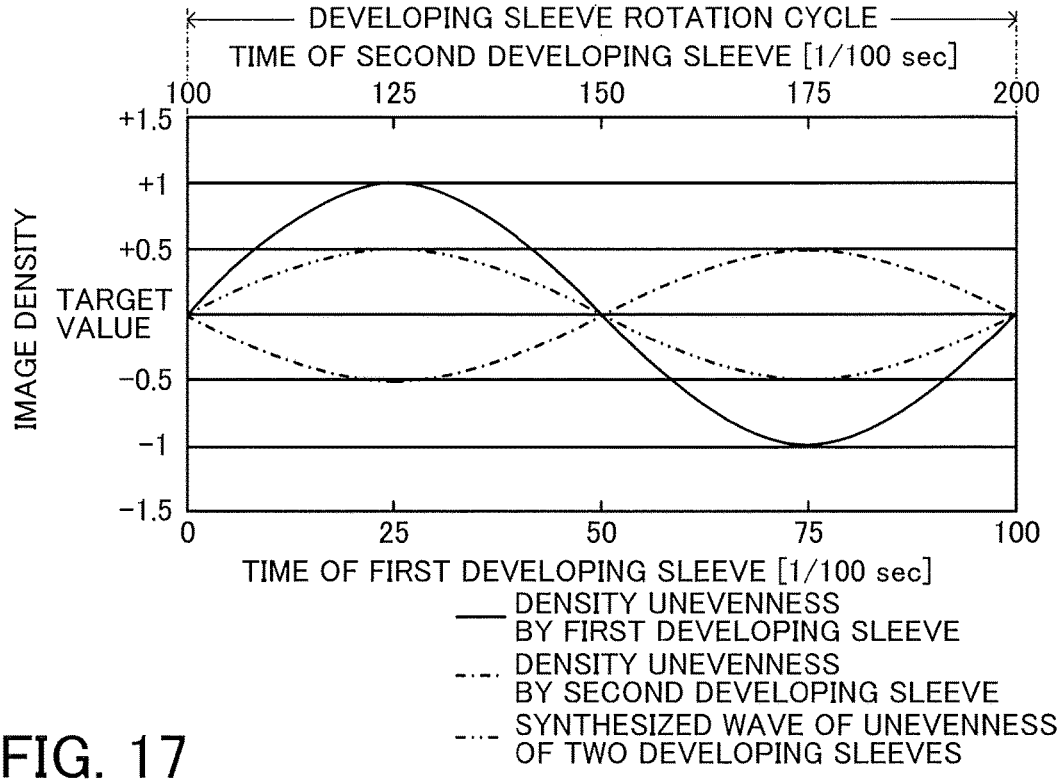
FIG. 16 is a graph illustrating various image density unevenness waveforms in a case where the sleeve rotational phases are made coincident with each other and the sleeve arrangement distance and a photoconductor rotation distance in ½ sleeve rotation period are set to be the same.

FIG. 16 is a graph illustrating various image density unevenness waveforms in a case where the sleeve rotational phases are made coincident with each other and the sleeve arrangement distance is set equal to the distance by which photoconductor rotates in half the rotation period of the developing sleeve (hereinafter "photoconductor rotation distance in ½ sleeve rotation"). In FIG. 16, 0 [1/100 sec] on the time axis of the first developing sleeve and 100 [1/100 sec] on the time axis of the second developing sleeve are at the same position in the X axis direction. This means that an image portion developed at the time of 0 [1/100 sec] by the first developing sleeve 81Y is developed again at the time of 50 [1/100 sec] by the second developing sleeve 82Y. The development by the second developing sleeve 82Y is shifted by ½ period from the development by the first developing sleeve 81Y.

In the case of FIG. 16, the waveform of the image density unevenness by the first developing sleeve is superimposed in opposite phase with the waveform of the image density unevenness by the second developing sleeve. A synthesized wave of the waveforms has the same phase as the waveform of the image density unevenness by the first developing sleeve and the amplitude that is half of the waveform of the image density unevenness by the first developing sleeve. The reason of the half is that the amplitude of the waveform of the image density unevenness by the second developing sleeve is half the amplitude of the waveform of the image density unevenness by the first developing sleeve.

Figure 17:
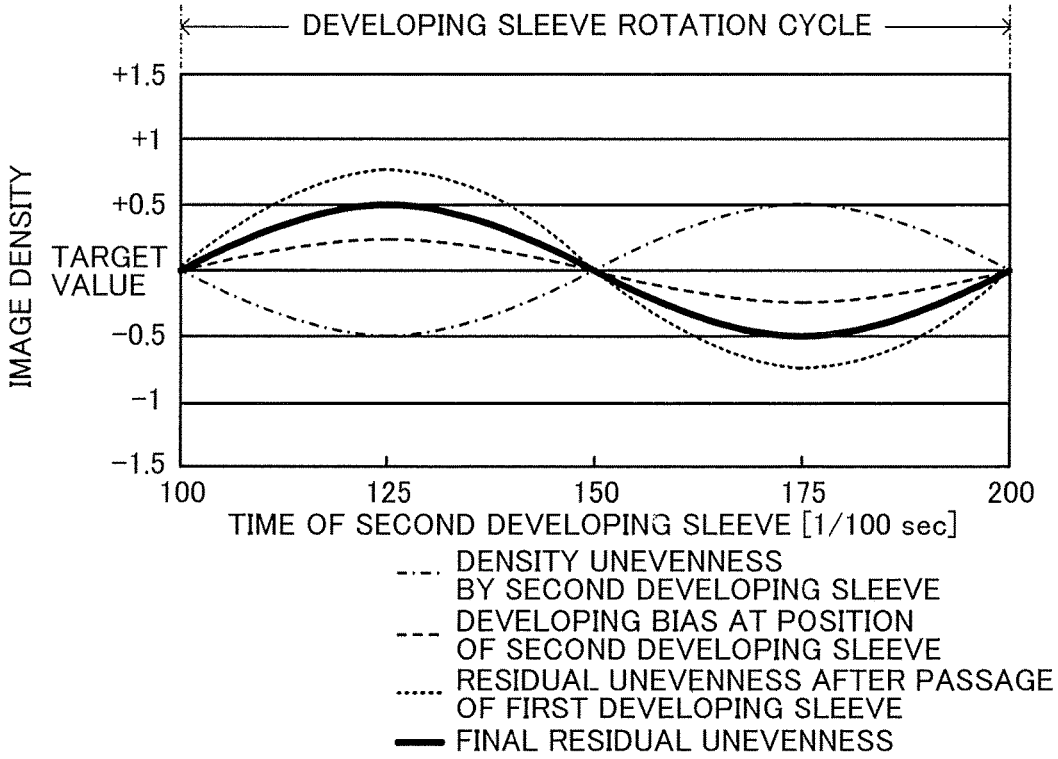
FIG. 17 is a graph illustrating various waveforms related to the second developing region in a case where the sleeve rotational phases are made coincident with each other and the sleeve arrangement distance and the photoconductor rotation distance in ½ sleeve rotation period are set to be the same.

FIG. 17 is a graph illustrating various waveforms related to the second developing region in a case where the sleeve rotational phases are made coincident with each other and the sleeve arrangement distance and the photoconductor rotation distance in ½ sleeve rotation are set to be the same. In this case, in the second developing region, the varied waveform (amplitude=0.25) of the developing bias and the waveform (amplitude=0.75) of the residual unevenness after passage of the first developing sleeve are superimposed in opposite phase with the waveform (amplitude=0.5) of the image density unevenness by the second developing sleeve, as illustrated in FIG. 17. With the superimposition, the waveform of the final residual unevenness has the amplitude of 0.5 and the same phase as the waveform of the residual unevenness after passage of the first developing sleeve. When comparing the synthesized wave illustrated in FIG. 16 with the waveform of the final residual unevenness illustrated in FIG. 17, the amplitude is the same at 0.5. This means that, even though the developing bias is periodically varied, the density maximum deviation amount of the final residual unevenness is the same as the density maximum deviation amount in the synthesized wave obtained in the case where the developing bias is not periodically varied. That is, the degree of image density unevenness is unchanged at all between the case where the developing bias is periodically varied and the case where the developing bias is not periodically varied.

The reason for this result is as follows. That is, assume that there is an ideal model of an image forming unit in which no image density unevenness with the rotation of the first developing sleeve 81Y and no image density unevenness with the rotation of the second developing sleeve 82Y occur at all. In this ideal model, when the developing bias is periodically varied, the image density unevenness caused by the periodic variation appears. In the first developing region, assume that the developing bias is periodically varied with a pattern drawing a valley-side arc of a sine wave in the first half period and a mountain-side arc of a sine wave in the next half period. Then, the behavior of the developing bias becomes as follows.

Developing Bias:

Valley-side arc (shaped like "U") from 0 to the middle of first period;

Mountain-side arc (shaped like "∩") from the middle of first period to end of first period; and Valley-side arc from the end of first period to the middle of second period.

In this pattern of the developing bias, the image density unevenness in the following pattern (hereinafter, first image density unevenness) occurs in the first developing region.

First Image Density Unevenness:

Mountain-side arc from 0 to the half period; and

Valley-side arc from the middle of first period to the end of first period.

This first image density unevenness is superimposed with the image density unevenness (hereinafter, second image density unevenness) occurring in the second developing region from the half period to the middle of second period. Since the developing bias is varied with the pattern of mountain-side arc and valley-side arc in the half period to the middle of second period, as described above, the pattern of the second image density unevenness occurring due to the variation becomes as follows.

Second Image Density Unevenness:

Valley-side arc from the middle of first period to the end of first period; and

Mountain-side arc from the middle of first period to the middle of second period.

Then, the first image density unevenness with the pattern of mountain-side arc and valley-side arc occurring in the first developing region and the second image density unevenness with the pattern of valley-side arc and mountain-side arc occurring in the second developing region are superimposed with the same amplitude and thus are offset, and the final residual unevenness is completely eliminated. In other words, the result is exactly the same as the case where the developing bias is not periodically varied.

A simulation was also conducted for a case where the sleeve rotational phases are made coincident with each other and the sleeve arrangement distance is set to the distance by which the photoconductor rotates while the developing sleeve makes 3/2 rotations. Then, as in the case where the sleeve arrangement distance is equal to the distance by which the photoconductor rotates while the developing sleeve makes ½ rotation, the waveform of the final residual unevenness becomes the same as the waveform of the final residual unevenness of the case where the developing bias is not periodically varied, even though the developing bias is periodically varied. Therefore, if the sleeve arrangement distance is set to the distance by which photoconductor rotates in a time length defined as multiplication of half the sleeve rotation period with an odd number, the effect of periodically varying the development bias is not attained.

Although the case in which the amplitude of the image density unevenness by the first developing sleeve is larger than the amplitude of the image density unevenness by the second developing sleeve has been described, a similar simulation was performed with the magnitude relation of the image density unevenness reversed, and a similar effect was obtained to the non-reversed case.

Therefore, in the image forming apparatus 1000, the sleeve rotational phases are made coincident with each other, and the sleeve arrangement distance is set to the distance by which photoconductor rotates in the length of time different from the multiplication of half the sleeve rotation period with an odd number.

As will be described below, making the sleeve rotational phases coincident with each other is dispensable. Even if the sleeve rotational phases are set to any values, a similar effect to the coincident case can be obtained.

Further, although the first developing sleeve 81Y and the second developing sleeve 82Y having the same diameter as each other have been used, the diameters of the developing sleeves may be made different as long as the rotation periods (one rotation times) of the developing sleeves are the same as each other. In this case, the developing sleeves are rotated at different angular velocities from each other, but the time required for one rotation is the same.

Further, although the example in which the waveform of the image density unevenness by the first developing sleeve and the waveform of the image density unevenness by the second developing sleeve are both sine waves has been described, a similar result may not be obtained in a case where the waveforms are not sine waves. Specifically, even if the sleeve arrangement distance is set to the distance by which photoconductor rotates in a time length equal to a multiplication of ½ of the sleeve rotation period by an odd number, the effect of suppressing the final residual unevenness due to periodic variation of the developing bias may be able to be obtained in some cases.

Four bias variation data individually corresponding to yellow, cyan, magenta, and black are constructed by performing construction processing at predetermined timing. This predetermined timing is timing prior to the first print job after factory shipment (hereinafter referred to as initial startup timing), timing when replacement of the image forming units 18Y, 18C, 18M, and 18K is detected (hereinafter referred to as replacement detection timing), and timing when an environmental variation amount that is a difference between an environment where the previous construction processing has been performed and a current environment exceeds a threshold value. At the initial startup timing or the timing when the environmental variation amount exceeds a threshold value, the bias variation data is constructed for each of all the yellow, cyan, magenta, and black. In contrast, at the replacement detection timing, the bias variation data is constructed for the image forming unit in which replacement has been detected. To enable such construction, the unit attach/detach sensors 28Y, 28C, 28M, and 28K (see FIG. 10) for individually detecting replacement of the image forming units 18Y, 18C, 18M, and 18K are provided.

The controller 110 uses a variation amount of absolute humidity as an environment as a variation amount of the environment. Then, the absolute humidity is calculated on the basis of a detection result of the temperature by an environmental sensor 124 and a detection result of the relative humidity by the environmental sensor 124. The absolute humidity is calculated and stored in previous construction processing. Then, thereafter, the calculation of the absolute humidity based on the detection results of the temperature and humidity by the environmental sensor 124 is periodically performed, and new construction processing is performed in a case where a difference (=environmental variation amount) between the value of the periodic calculation and the stored value of the absolute humidity exceeds a predetermined threshold value.

Figure 18:
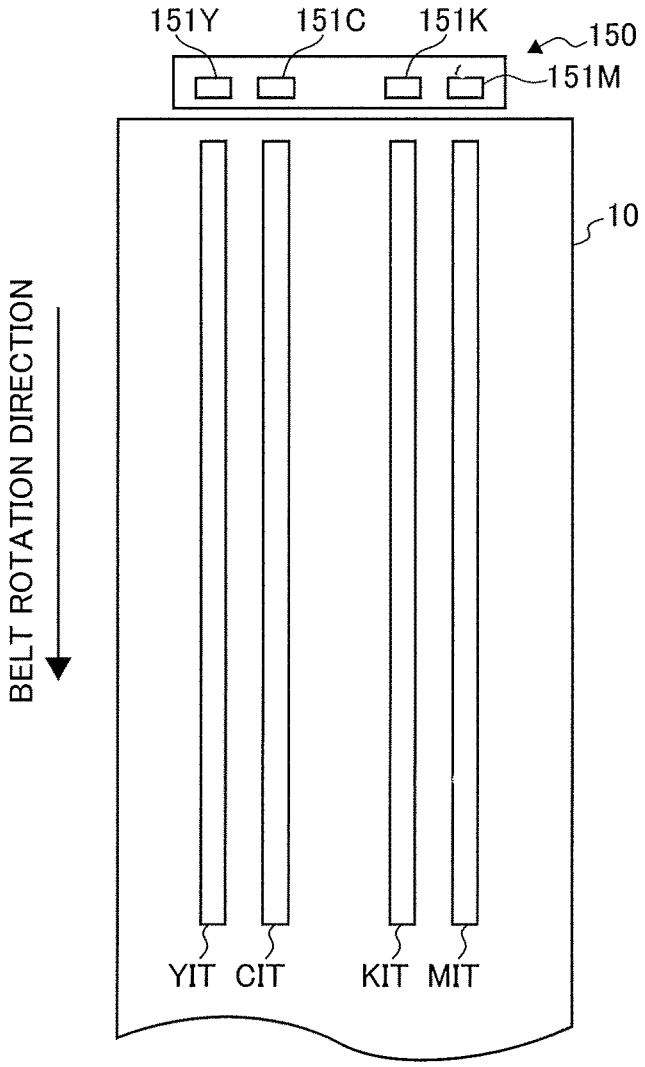
FIG. 18 is a schematic plan view illustrating a test toner image of colors transferred to an intermediate transfer belt of the image forming section.

In the construction processing at the initial startup timing, first, a Y test toner image including a Y solid toner image is formed on the photoconductor 20Y. Further, a C test toner image, an M test toner image, and a K test toner image including a C solid toner image, an M solid toner image, and a K solid toner image are formed on the photoconductor 20C, the photoconductor 20M, and the photoconductor 20K. Then, as illustrated in FIG. 18, these test toner images are primarily transferred onto the intermediate transfer belt 10. In FIG. 18, a Y test toner image YIT is for detecting the image density unevenness occurring in the rotation period of the photoconductor 20Y and is thus formed in a longer length than a peripheral length of the photoconductor 20Y in the belt rotation direction. Similarly, the lengths in the belt rotation direction of a C test toner image CIT, an M test toner image MIT, and a K test toner image KIT are longer than the peripheral lengths of the photoconductors 20C, 20M, and 20K.

Note that, for the sake of convenience, FIG. 18 illustrates an example in which the four test toner images (YIT, CIT, MIT, and KIT) are formed on a straight line in the belt width direction. However, in practice, formation positions of the individual test toner images on the belt may be shifted by up to the same value as the peripheral length of the photoconductor in the belt rotation direction. This is because, for example, image formation of the test toner image is started to make a leading end position of the test toner image coincident with a reference position in the rotation direction of the photoconductor (a photoconductor surface position that enters the first developing region at the reference position timing) for each color. That is, the test toner image of each color is formed such that the leading end of the test toner image coincides with the reference position in the rotation direction of the photoconductor.

As the test toner image, a halftone toner image may be formed instead of the solid toner image. For example, a halftone toner image having a dot area ratio of 70 [%] may be formed.

The controller 110 performs the construction processing in combination with the process control processing. Specifically, the controller 110 performs the process control processing immediately before performing the construction processing and determines the developing bias reference values for the colors. Then, the test toner image is developed under a condition that the developing bias reference value determined in the process control processing is constantly output, for each of the colors, in the construction processing performed immediately after the process control processing. Theoretically, the test toner image is formed to have the target toner adhesion amount, but in reality, the image density unevenness coinciding with the rotation of the first developing sleeve and that of the second developing sleeve appears.

A time lag from the start of the image formation of the test toner image (from the start of writing the electrostatic latent image) to when the leading end of the test toner image enters the detection position by the reflective photosensor of the optical sensor unit 150 is a different value in each color. However, in the case of the same color, the time lag is a constant value over time (hereinafter, this value is referred to as a write-detection time lag).

The controller 110 stores the write-detection time lag in the non-volatile memory in advance for each color. Then, the controller 110 starts sampling of the output of the reflective photosensor for each color from a point of time when the write-detection time lag has elapsed after the image formation of the test toner image is started. This sampling is repeated at predetermined time intervals. The time interval is the same value as a time interval for reading individual data in the output pattern data used in the bias-output varying processing for varying the developing bias on the basis of the bias variation data. The controller 110 constructs an equation of the image density unevenness waveform indicating a relationship between the toner adhesion amount (image density) and the time (or the photoconductor surface position) on the basis of sampling data, for each color, and extracts the image density unevenness waveform in the sleeve rotation period from the image density unevenness waveform.

Next, the controller 110 calculates an average toner adhesion amount (average image density value) of the test toner image for each color. The average toner adhesion amount is a value substantially reflecting the average image density value in the sleeve rotation period. Therefore, the controller 110 constructs the bias variation data for offsetting the image density unevenness in the sleeve rotation period with reference to the average toner adhesion amount. Specifically, the controller 110 calculates bias output differences individually corresponding to a plurality of toner adhesion amount data included in the image density unevenness waveform. The bias output difference is based on the average toner adhesion amount.

The bias output difference corresponding to the toner adhesion amount data having the same value as the average toner adhesion amount is calculated as zero. Further, the bias output difference corresponding to the toner adhesion amount data larger than the average toner adhesion amount is calculated as a positive polarity value according to a difference between the toner adhesion amount and the average toner adhesion amount. The bias output difference is a positive polarity bias output difference and is thus data that changes a negative polarity developing bias to a lower value (a value of a smaller absolute value) than the developing bias reference value. Further, the bias output difference corresponding to the toner adhesion amount data smaller than the average toner adhesion amount is calculated as a negative polarity value according to a difference between the toner adhesion amount and the average toner adhesion amount. The bias output difference is a negative polarity bias output difference and is thus data that changes a positive polarity developing bias to a higher value (a value of a larger absolute value) than the developing bias reference value.

In this way, the bias output differences corresponding to the individual toner adhesion amount data are obtained, and data in which these bias output differences are arranged in order is constructed as the bias variation data.

As described above, the output values from the developing power sources (11Y, 11C, 11M, and 11K) of the developing bias Vb are changed in the bias-output varying processing using the bias variation data constructed in the construction processing, for the respective colors.

Note that the photoconductor rotation distance in one sleeve rotation changes according to a linear velocity of the photoconductor. In this copier, a high-speed print mode and a high-image-quality print mode for driving the photoconductor at a lower linear velocity than the high-speed print mode can be switched. The sleeve one period moving distance described so far is a distance in the high-image-quality print mode.

Next, modifications in which a part of the configuration of the image forming apparatus according to the above embodiment is modified to another configuration will be described.

Note that the configuration of the image forming apparatus according to each modification is similar to the configuration of the embodiment unless otherwise stated below.

First Modification

In the above-described embodiment, the sleeve rotational phases are made coincident with each other, and the sleeve arrangement distance is made different from the multiplication with an odd number of the photoconductor rotation distance in half the sleeve rotation period. This configuration can secure the effect of periodically varying the developing bias. However, with such a configuration, verification as to whether an effect of suppressing image density unevenness by periodically varying a developing bias can be certainly obtained is required.

Therefore, the inventor of the present invention adopted various values as values different from the multiplication with an odd number of the photoconductor rotation distance in half the sleeve rotation period, and conducted a simulation to investigate final residual unevenness, setting a sleeve arrangement distance to each of the various values. Specifically, by shifting the sleeve arrangement distance bit by bit from the same value as the above solution, a synthesized wave of image density unevenness by a first developing sleeve and image density unevenness by a second developing sleeve, and a waveform of final residual unevenness were examined. Then, by setting the sleeve arrangement distance to the multiplication of the photoconductor rotation distance in one sleeve rotation by a value in a range of 0.01 to 0.49, the amplitude reduction effect of the final residual unevenness due to periodic variation of the developing bias can be obtained. Further, by setting the sleeve arrangement distance to the multiplication of the photoconductor rotation distance in one sleeve rotation by a value in a range of 0.51 to 1.00, the amplitude reduction effect of the final residual unevenness due to periodic variation of the developing bias can be obtained. In other words, by setting the sleeve arrangement distance to the following value, the amplitude reduction effect of the final residual unevenness due to periodic variation of the developing bias can be obtained. That is, the sleeve arrangement distance is set to the multiplication of the photoconductor rotation distance in one sleeve rotation with the sum of an integer (including 0) and a value from 0 to 0.49, or the multiplication of the photoconductor rotation distance in one sleeve rotation with a value calculated by subtracting a value in a range from 0.51 to 0.99 from an integer (not including 0).

In a second developing region, a relationship of phases of a waveform of residual unevenness after passage of the first developing sleeve, a waveform of the image density unevenness by the second developing sleeve, and a varied waveform of the developing bias is affected by sleeve rotational phases in addition to the sleeve arrangement distance. An example in which the sleeve rotation phases are made coincident with each other has been described so far. A relationship between the amplitude of the synthesized wave of the image density unevenness and the amplitude of the final residual unevenness was examined by a simulation in a configuration in which the sleeve rotational phases are shifted from each other. As a shift amount of the sleeve rotational phases, three types of 90°, 180°, and 270° were adopted. Then, a similar result to the case where the sleeve rotational phases coincide with each other was obtained regardless of any shift amount. That is, irrespective of the sleeve rotational phases, by setting the sleeve arrangement distance to a value different from the multiplication of half the photoconductor rotation distance in one sleeve rotation by an odd number, the effect of suppressing the final residual unevenness due to periodic variation of the developing bias can be obtained.

Therefore, in an image forming apparatus 1000 according to the first modification, a limitation that the sleeve arrangement distance is set to the following value is set without setting a limitation on the sleeve rotational phases. That is, the sleeve arrangement distance is set to the multiplication of the photoconductor rotation distance in one sleeve rotation with the sum of an integer (including 0) and a value from 0 to 0.49, or the multiplication of the photoconductor rotation distance in one sleeve rotation with a value calculated by subtracting a value in a range of 0.51 to 0.99 from an integer (not including 0).

Second Modification

In an image forming apparatus 1000 according to a second modification, a sleeve arrangement distance is set to a same value as an integral multiple (not including 0) of a sleeve one period moving distance of a photoconductor without setting a limitation on sleeve rotational phases. In such a configuration, as described with reference to FIG. 15, final residual unevenness can be substantially eliminated by periodically varying a developing bias.

In FIG. 15, an example in which the sleeve rotational phases are made coincident with each other has been described. However, even if a shift amount of the sleeve rotational phases is set to any value, a synthesized wave of image density unevenness of first and second developing sleeves has the same shape and phase in each rotation of the developing sleeves. Therefore, by adopting a developing bias having amplitude of 1/the number of sleeves and having an opposite phase to the synthesized wave with reference to a time axis of when a photoconductor surface enters a first developing region, the final residual unevenness can be substantially eliminated.

Third Modification

Amplitude of image density unevenness that increases and decreases in a period of 1/N (N=an integer) of the sleeve rotation period may be larger than amplitude of image density unevenness that increases and decreases in a sleeve rotation period, depending on electrical resistance unevenness or external distortion of a developing sleeve. Hereinafter, a waveform of image density unevenness that increases and decreases in a period of ½ of the sleeve rotation period is referred to as a double wave. Further, a waveform of image density unevenness that increases and decreases in a period of ⅓ of the sleeve rotation period is referred to as a triple wave.

Figure 19:
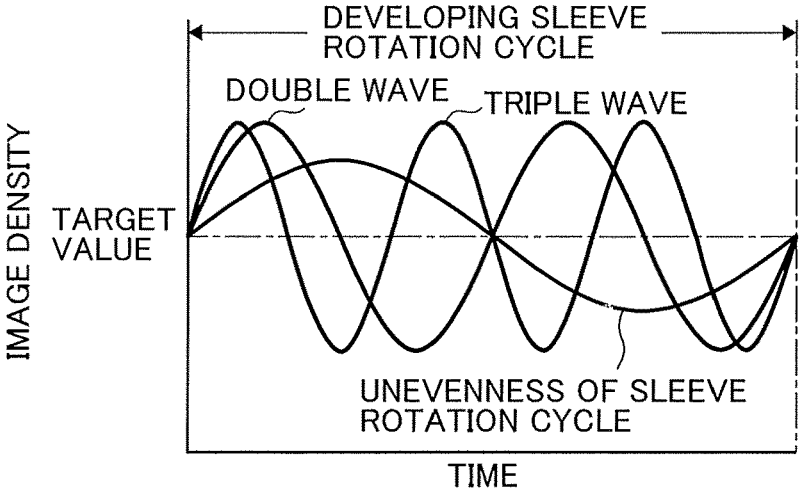
FIG. 19 is a graph for describing a double wave and a triple wave.

FIG. 19 is a graph for describing the double wave and the triple wave. As illustrated in FIG. 19, the double wave generates two sinusoidal waveforms in the sleeve rotation period. Further, the triple wave generates three sinusoidal waveforms in the sleeve rotation period.

In the case of the double wave, a sleeve arrangement distance is set to a value different from a multiplication of ¼ of the sleeve rotation period by an odd number, whereby an effect of periodically varying a developing bias being not exhibited can be avoided.

Further, in the case of the triple wave, the sleeve arrangement distance is set to the value different from a multiplication of ¼ of the sleeve rotation period by an odd number, whereby the effect of periodically varying a developing bias being not exhibited can be avoided.

Therefore, in the third modification, aiming at suppression of image density unevenness of the double wave or the triple wave, the sleeve arrangement distance is set to a value different from a multiplication of ¼ or ⅙ of the sleeve rotation period by an odd number. The developing bias is varied according to a variation pattern in an opposite phase (the amplitude is ½) to a synthesized wave of the image density unevenness of the double wave by a first developing sleeve and the image density unevenness of the double wave by a second developing sleeve. Alternatively, the developing bias is varied according to a variation pattern in an opposite phase (the amplitude is ½) to a synthesized wave of the image density unevenness of the triple wave by the first developing sleeve and the image density unevenness of the triple wave by the second developing sleeve.

A specific example of the sleeve arrangement distance is one of the following four values.

The same value as the multiplication of the photoconductor rotation distance in ½ sleeve rotation with the sum of an integral (including 0) and a value ranging from 0 to 0.49.

The same value as the multiplication of the photoconductor rotation distance in ½ sleeve rotation with a value calculated by subtracting a value ranging from 0.51 to 0.99 from an integer (not including 0).

The same value as the multiplication of a photoconductor rotation distance in ⅓ sleeve rotation with the sum of an integral (including 0) and a value ranging from 0 to 0.49.

The same value as the multiplication of the photoconductor rotation distance in /3 sleeve rotation with a value calculated by subtracting a value ranging from 0.51 to 0.99 from an integer (not including 0).

Fourth Modification

In a fourth modification, aiming at elimination of image density unevenness of a double wave or a triple wave, a sleeve arrangement distance is set to be a same value as a multiplication of ¼ or ⅙ of a sleeve rotation period by an even number. With such a configuration, occurrence of the image density unevenness of the double wave or the triple wave can be substantially eliminated.

An example of the copier provided with the yellow, cyan, magenta, and black four image forming units 18Y, 18C, 18M, and 18K has been described so far. However, the present disclosure can also be applied to a monochrome machine provided with one image forming unit. Further, an example of the copier that primarily transfers the toner images of respective colors in a superimposed manner onto the intermediate transfer belt has been described. However, the present disclosure can also be applied to an image forming apparatus that primarily transfers toner images in a superimposed manner onto a recording sheet held by an intermediate transfer belt. Further, the present disclosure can also be applied to an image forming apparatus that transfers a monochrome toner image from a photoconductor onto a recording sheet.

The above description is merely an example, and specific effects are exerted in each of the following aspects.

First Aspect

A first aspect is an image forming apparatus including a latent image bearer (for example, the photoconductor 20Y) to bear a latent image and a developing device (for example, the developing device 80Y) including a plurality of developer bearers (for example, the first developing sleeve 81Y and the second developing sleeve 82Y) to develop the latent image on the latent image bearer, and which periodically varies and outputs a developing bias to be applied to each of the plurality of developer bearers from a common power source (for example, the developing power source 11Y), and the image forming apparatus causes each surface of the plurality of developer bearers to rotate and move in a same period, and varies an output value of the developing bias in a same period as the period on the basis of a detection result by a posture detector (for example, the sleeve rotation sensor 76Y) to detect an endless moving posture of a surface of at least one of the plurality of developer bearers.

In the first aspect, since the surfaces of the plurality of developer bearers are rotated and moved in the same period, periods of periodic image density unevenness occurring with the surface endless movement of the respective developer bearers become the same as one another. Then, when the surface of the latent image bearer sequentially passes through developing positions of the plurality of developer bearers, image density unevenness occurring with the surface movement of the upstream developer bearer and image density unevenness occurring with the surface movement of the downstream developer bearer are superimposed. In which phases the image density unevenness is superimposed on each other is determined according to a shift amount between the phase of the surface endless movement in the upstream developer bearer and the phase of the surface endless movement in the downstream developer bearer, and a distance between the developer bearers. The combination of the shift amount and the distance is unchanged in each rotation of the plurality of developer bearers that performs the surface endless movement in the same period. Therefore, a waveform of final image density unevenness after the most downstream developer bearer has passed the developing position is the same in each rotation of the developer bearer. Further, timing to detect, by the posture detector, a predetermined endless moving posture of at least one of the plurality of developer bearers that performs the surface endless movement in the same period is timing to detect the predetermined endless moving posture of another developer bearer. The developing bias is varied with a pattern to make the amplitude of the waveform of the final image density unevenness smaller, whereby the image density unevenness in the surface rotation period of the developer bearers, which occurs with the surface endless movement of the plurality of developer bearers, can be suppressed.

Second Aspect

In a second aspect, the controller varies the developing bias with a waveform in an opposite phase on a time axis based on when the surface of the latent image bearer enters a developing position by the developer bearer that first performs a developing process, of the plurality of developer bearers, with respect to a periodic image density unevenness waveform appearing in an image after developing by the developer bearer that last performs the developing process, of the plurality of developer bearers, is completed, in the first aspect. With such a configuration, the developing bias is varied with a waveform in an opposite phase to the periodic image density unevenness appearing in the image after completion of the final development, whereby the image density unevenness in the surface rotation period of the developer bearers, which occurs with the surface endless movement of the plurality of developer bearers, can be suppressed.

Third Aspect

In a third aspect, an arrangement distance on the surface of the latent image bearer between the upstream developer bearer and the downstream developer bearer adjacent to each other along a rotation direction of the latent image bearer is set to be a distance by which the surface of the latent image bearer moves in a time of a value different from a multiplication of ½ of the period by an odd number, in the second aspect. With such a configuration, as already described, the effect of periodically varying the developing bias being not exhibited for the image density unevenness appearing as a sinusoidal variation pattern with the rotation of the developer bearer can be avoided.

Fourth Aspect

In a fourth aspect, the arrangement distance is set to be a distance by which the surface of the latent image bearer moves in a time of a same value as a multiplication of ½ of the period by an even number, in the third aspect. With such a configuration, the image density unevenness of the surface rotation period of the developer bearers, which occurs with the surface endless movement of the plurality of developer bearers, can be substantially eliminated.

Fifth Aspect

In a fifth aspect, an arrangement distance on the surface of the latent image bearer between the upstream developer bearer and the downstream developer bearer adjacent to each other along a rotation direction of the latent image bearer is set to be a distance by which the surface of the latent image bearer moves in a time of a value different from a multiplication of ¼ of the period by an odd number or a value different from a multiplication of ⅙ of the period by an odd number, in the second aspect. With such a configuration, the effect of periodically varying the developing bias being not exhibited for image density unevenness appearing as a double wave or a triple wave made of sine waves can be avoided.

Sixth Aspect

In a sixth aspect, the arrangement distance is set to be a distance by which the surface of the latent image bearer moves in a time of a same value as a multiplication of ¼ of the period by an even number or a same value as a multiplication of ⅙ of the period by an even number, in the fifth aspect. With such a configuration, the image density unevenness appearing as the double wave and the triple wave with the surface movement of the plurality of developer bearers can be substantially eliminated.

Seventh Aspect

In a seventh aspect, processing of constructing pattern data for periodically varying the developing bias is performed at predetermined timing on the basis of a detection result, by an image density detector, of image density unevenness that becomes a same pattern each time of the period in the test image obtained by developing the latent image on the latent image bearer by the developing device under a condition in which the developing bias is set to a constant value, in the second, third, fourth, fifth, or sixth aspect. With such a configuration, pattern data of variation of the developing bias capable of suppressing the image density unevenness occurring with the surface endless movement of the plurality of developer bearers can be constructed automatically irrespective of an operator.

Eighth Aspect

An eighth aspect is a developing device mounted on an image forming apparatus including a latent image bearer to bear a latent image and a developing device including a plurality of developer bearers to develop the latent image on the latent image bearer, and which periodically varies and outputs a developing bias to be applied to each of the plurality of developer bearers from a common power source, and the developing device being mounted in the first, second, third, fourth, fifth, sixth, or seventh aspect.

Ninth Aspect

A ninth aspect is an image forming unit mounted on an image forming apparatus including a latent image bearer to bear a latent image and a developing device including a plurality of developer bearers to develop the latent image on the latent image bearer, and which periodically varies and outputs a developing bias to be applied to each of the plurality of developer bearers from a common power source, in which at least the latent image bearer and the developing device are configured as one unit and are integrally attached or detached to or from an image forming apparatus main body, and the image forming unit being mounted in the first, second, third, fourth, fifth, sixth, or seventh aspect.

The above-described embodiments are illustrative and do not limit the present invention. Thus, numerous additional modifications and variations are possible in light of the above teachings. For example, elements and/or features of different illustrative embodiments may be combined with each other and/or substituted for each other within the scope of the present invention.

Any one of the above-described operations may be performed in various other ways, for example, in an order different from the one described above.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image forming apparatus comprising:

a latent image bearer configured to bear a latent image;

a developing device configured to develop the latent image on the latent image bearer with developer, the developing device including a plurality of developer bearers configured to bear the developer;

a rotation position detector configured to detect a rotation position of at least one of the plurality of developer bearers;

a common power source configured to apply a developing bias to each of the plurality of developer bearers; and circuitry configured to:

cause the plurality of developer bearers to rotate in a same rotation period; and cause the common power source to periodically vary an output value of the developing bias in a same period as the rotation period based on a detection result by the rotation position detector.

2. The image forming apparatus according to claim 1, wherein the circuitry is configured to:

obtain a waveform of periodic image density unevenness appearing in an image after developing by extreme-downstream one of the plurality of developer bearers in a rotation direction of the latent image bearer;

construct an opposite-phase waveform, opposite in phase to the waveform of periodic image density unevenness, on a time axis with reference to a timing at which a surface of the latent image bearer reaches a developing position by extreme upstream one of the plurality of developer bearers in the rotation direction of the latent image bearer; and vary the developing bias with the opposite-phase waveform.

3. The image forming apparatus according to claim 2, wherein an arrangement distance on the surface of the latent image bearer between adjacent two of the plurality of developer bearers in the rotation direction of the latent image bearer is equal to a distance by which the latent image bearer rotates in a time length different from a multiplication of ½ of the rotation period with an odd number.

4. The image forming apparatus according to claim 3, wherein the arrangement distance is equal to a distance by which the latent image bearer rotates in a same time length as a multiplication of ½ of the rotation period with an even number.

5. The image forming apparatus according to claim 2, wherein an arrangement distance on the surface of the latent image bearer between adjacent two of the plurality of developer bearers in a rotation direction of the latent image bearer is equal to a distance by which the latent image bearer rotates in a time length different from a multiplication of ¼ of the rotation period with an odd number.

6. The image forming apparatus according to claim 5, wherein the arrangement distance is equal to a distance by which the latent image bearer rotates in a same time length as a multiplication of ¼ of the rotation period with an even number.

7. The image forming apparatus according to claim 2, wherein an arrangement distance on the surface of the latent image bearer between adjacent two of the plurality of developer bearers in a rotation direction of the latent image bearer is equal to a distance by which the latent image bearer rotates in a time length different from a multiplication of ⅙ of the rotation period with an odd number.

8. The image forming apparatus according to claim 7, wherein the arrangement distance is equal to a distance by which the latent image bearer rotates in a same time length as a multiplication of ⅙ of the rotation period with an even number.

9. The image forming apparatus according to claim 2, further comprising an image density detector configured to detect a density of an image on the latent image bearer, wherein the circuitry is configured to perform, at a predetermined timing, processing of constructing pattern data for periodically varying the developing bias, the processing including:

developing, with the developing device, a test pattern on the latent image bearer into a test image with the developing bias set to a constant value;

obtaining, with the image density detector, image density unevenness pattern of the test image, the image density unevenness pattern having a period same as the rotation period; and constructing the pattern data based on the image density unevenness pattern.

10. A developing device comprising:

a plurality of developer bearers configured to bear developer to develop a latent image on a latent image bearer, the plurality of developer bearers to be rotated in a same rotation period and applied with a developing bias from a common power source; and a rotation position detector configured to detect a rotation position of at least one of the plurality of developer bearers, the developing bias having an output value varied in a same period as the rotation period based on a detection result by the rotation position detector.

11. An image forming unit comprising:

the latent image bearer configured to bear the latent image; and the developing device according to claim 10, configured to develop the latent image.

* * * * *